US011350744B2

(12) United States Patent
Kobayashi

(10) Patent No.: US 11,350,744 B2
(45) Date of Patent: Jun. 7, 2022

(54) STORAGE BOX

(71) Applicant: Iris Ohyama Inc., Sendai (JP)

(72) Inventor: Susumu Kobayashi, Miyagi (JP)

(73) Assignee: IRIS OHYAMA INC., Sendai (JP)

( * ) Notice: Subject to any disclaimer, the term of this patent is extended or adjusted under 35 U.S.C. 154(b) by 119 days.

(21) Appl. No.: 16/937,485

(22) Filed: Jul. 23, 2020

(65) Prior Publication Data

US 2021/0137268 A1 May 13, 2021

(30) Foreign Application Priority Data

May 31, 2019 (JP) ..... JP2019-102177

(51) Int. Cl.

| | |
|---|---|
| ***A47B 88/40*** | (2017.01) |
| ***A47B 87/02*** | (2006.01) |
| ***B65D 21/02*** | (2006.01) |
| *A47B 88/407* | (2017.01) |

(52) U.S. Cl.

CPC ..... *A47B 88/402* (2017.01); *A47B 87/0215* (2013.01); *B65D 21/02* (2013.01); *A47B 88/407* (2017.01); *B65D 21/0233* (2013.01)

(58) Field of Classification Search

CPC ..... A47B 88/402; A47B 87/0215; A47B 87/0269; A47B 87/02; A47B 87/0207; A47B 87/0253; A47B 87/0261; A47B 88/00; A47B 88/407; A47B 63/00; A47B 47/00; A47B 47/0008; A47B 47/005; A47B 47/0083; A47B 47/0091; A47B 47/027; A47B 47/047; B65D 21/0215; B65D 21/0212; B65D 21/0209; B65D 21/02; B65D 21/022; B65D 21/0223; B65D 21/0224; B65D 21/0233; B65D 21/048

USPC ..... 206/503, 509, 510, 511, 512; 220/380; 108/180

See application file for complete search history.

(56) References Cited

U.S. PATENT DOCUMENTS

| | | | | | |
|---|---|---|---|---|---|
| 1,340,562 | A * | 5/1920 | Sandmann | A47B 87/02 | 312/108 |
| 2,641,383 | A * | 6/1953 | Coursey | B65D 21/062 | 206/506 |
| 2,747,748 | A * | 5/1956 | Barefoot | A21C 15/00 | 294/142 |
| 2,962,334 | A * | 11/1960 | Dutmers | A47B 87/02 | 312/108 |

(Continued)

FOREIGN PATENT DOCUMENTS

| | | |
|---|---|---|
| JP | 3028537 U | 6/1996 |

*Primary Examiner* — Devin K Barnett

(74) *Attorney, Agent, or Firm* — Studebaker & Brackett PC

(57) ABSTRACT

In a skeleton frame of a storage box, a boundary frame, front columns, and rear columns are integrally formed. Therefore, the ease of assembly of the storage box can be improved. In addition, gouged portions that are depressed inward in a width direction from an outermost shape in the width direction of the boundary frame are formed in both side portions in the width direction of the boundary frame. When the skeleton frames are nested, the front columns of the skeleton frame on a lower side are disposed in the gouged portions of the skeleton frame on an upper side. Accordingly, even in the skeleton frame where the rear columns and the front columns are integrally formed with the boundary frame, the skeleton frames can be nested in a vertically stacked state.

9 Claims, 13 Drawing Sheets

(56) References Cited

U.S. PATENT DOCUMENTS 3,030,163 A * 4/1962 Gottsegen ..... A47B 87/02 312/111
3,113,680 A * 12/1963 Frater ..... B65D 21/048 211/126.4
3,446,544 A * 5/1969 Serwer ..... A47B 87/0292 312/111
3,529,878 A * 9/1970 Blowers ..... A47B 87/0292 312/107
3,606,506 A * 9/1971 Ungaro ..... A47B 87/00 312/111
3,644,008 A * 2/1972 Overby ..... A47B 87/0253 312/107
3,653,734 A * 4/1972 Ungaro ..... A47B 88/90 312/107
3,847,460 A * 11/1974 Weidt ..... A47B 47/04 312/265.2
3,851,936 A * 12/1974 Muller ..... F16B 12/20 312/108
3,887,073 A * 6/1975 Wilson ..... B65D 21/048 206/507
4,039,119 A * 8/1977 Crane ..... B65D 5/004 206/510
4,043,477 A * 8/1977 Deese ..... G09F 5/00 220/23.4
4,056,295 A * 11/1977 Downing ..... A47B 87/02 312/107
4,227,642 A * 10/1980 Ortel ..... B65D 5/004 206/503
4,239,306 A * 12/1980 Klaus ..... A47B 47/06 211/194
4,266,714 A * 5/1981 Crane ..... B65D 5/004 206/509
4,378,137 A * 3/1983 Gibson ..... A47B 87/02 312/108
4,441,615 A * 4/1984 Goodrich ..... B65D 21/041 206/505
4,448,463 A * 5/1984 Amos ..... A47B 67/00 312/111
4,592,601 A * 6/1986 Hlinsky ..... A47B 87/02 206/504
4,671,411 A * 6/1987 Rehrig ..... B65D 21/048 206/505
4,759,451 A * 7/1988 Apps ..... B65D 21/041 206/505
4,760,921 A * 8/1988 Licari ..... A47B 87/0269 206/504
4,844,566 A * 7/1989 Moore ..... A47B 47/042 312/108
4,852,749 A * 8/1989 Fernandez ..... A47J 36/24 211/126.2
5,492,399 A * 2/1996 Tillack ..... A47B 87/0253 108/91
5,704,482 A * 1/1998 Apps ..... B65D 21/04 206/510
5,752,602 A * 5/1998 Ackermann ..... B65D 21/046 206/505
5,816,674 A * 10/1998 Manos ..... A47B 87/0284 312/290
6,732,858 B1 * 5/2004 Chang Ou ..... A47B 87/0276 206/278
D536,738 S * 2/2007 Smith ..... D19/92
7,281,648 B2 * 10/2007 Lowry ..... B65D 5/321 206/511
7,387,350 B2 * 6/2008 Killinger ..... A45C 13/02 220/817
7,568,581 B2 * 8/2009 Dreano ..... A22C 7/0053 206/503
8,016,370 B2 * 9/2011 Grainger ..... A47B 67/04 312/111
8,113,600 B2 * 2/2012 Zalewski ..... A47B 47/0041 312/111
8,210,372 B2 * 7/2012 Visser ..... B65D 19/0002 211/126.7
8,544,648 B2 * 10/2013 Cleveland ..... B65D 81/3823 206/508
8,955,928 B2 * 2/2015 Cheng ..... A47B 47/0033 312/265.2
2002/0185941 A1 * 12/2002 Ferraro ..... A47B 87/0253 312/107
2005/0269917 A1 * 12/2005 Ohayon ..... A47B 87/0207 312/108
2011/0241502 A1 * 10/2011 Kao ..... F16B 12/52 312/111
2015/0015128 A1 * 1/2015 Matlin ..... A47B 87/0292 312/111
2015/0232238 A1 * 8/2015 Wu ..... B65D 25/38 220/811
2015/0320207 A1 * 11/2015 Chan ..... A47B 87/0276 312/108
2016/0009448 A1 * 1/2016 Hassell ..... B65D 1/34 206/511
2017/0137173 A1 * 5/2017 Shamp ..... B65D 25/22
2019/0008275 A1 * 1/2019 Sosna ..... B65D 21/045
2019/0276184 A1 * 9/2019 Kobayashi ..... B65D 43/0202
2020/0024032 A1 * 1/2020 Urban ..... A47B 87/0261

* cited by examiner

STORAGE BOX

BACKGROUND OF THE INVENTION

Field of the Invention

The present invention relates to a storage box.

Background Art

A storage box described in Japanese Registered Utility Model No. 3028537 is configured to include frames that are stacked in a plurality of stages, and drawers (case bodies) that are slidably accommodated inside the frames. In addition, the frame is configured to include an outer frame and four columns protruding upward from four corners of the outer frame, and the outer frame and the columns are integrally formed.

Therefore, when the storage box is assembled, it is not required to assemble the outer frame and the columns, and thus the ease of assembly of the storage box can be improved.

SUMMARY OF THE INVENTION

However, in the above storage box, the frame does not have a nestable configuration where the frames can be vertically stacked when the storage box is in a disassembled state. Accordingly, for example, a packaging form of the storage box becomes relatively large. Therefore, the above storage box has room for improvement in terms of improving the transport efficiency of the storage box.

In light of the above circumstances, an object of the present invention is to provide a storage box that can save space in packaging form while improving the ease of assembly.

According to one or more embodiments of the present invention, there is provided a storage box including: a skeleton frame; and a case body that is formed in a box shape which is open upward, and is accommodated in the skeleton frame so as to be slidable in a forward and rearward direction. The skeleton frame includes a bottom frame on which the case body is to be placed, a pair of rear columns that are integrally formed with the bottom frame to protrude upward from both end portions in a width direction of a rear end portion of the bottom frame, and a pair of front columns that are integrally formed with the bottom frame to protrude upward from both end portions in the width direction of a front end side portion of the bottom frame. A pair of gouged portions that are depressed inward in the width direction from an outermost shape in the width direction of the bottom frame are formed between the front columns and the rear columns in both side portions in the width direction of the bottom frame. When the skeleton frames are nested, the front columns of the skeleton frame on a lower side are disposed in the gouged portions of the skeleton frame on an upper side.

In the storage box according to one or more embodiments of the present invention, the gouged portions extend in the forward and rearward direction over entire portions between the front columns and the rear columns in the both side portions in the width direction of the bottom frame. In a plan view, a bottom surface of the gouged portion is formed as a curved surface that is convex outward in the width direction of the bottom frame. When the skeleton frames are nested, the front columns of the skeleton frame on the lower side are disposed in front end portions of the gouged portions of the skeleton frame on the upper side, and the curved surfaces of the skeleton frame on the upper side are in contact with corners on a rear side of the front columns of the skeleton frame on the lower side.

In the storage box according to one or more embodiments of the present invention, the bottom frame is formed in a rectangular frame shape. An outer peripheral rib that is bent downward and forms the gouged portions is formed at an outer peripheral edge of the bottom frame. A pair of first reinforcement portions extending in the forward and rearward direction are formed in outer peripheral portions on both sides in the width direction of the bottom frame, and the first reinforcement portions are formed in a groove shape that is elevated above the bottom frame and is open downward.

In the storage box according to one or more embodiments of the present invention, a front end portion of the first reinforcement portion is inclined outward in a width direction of the skeleton frame as the front end portion extends forward, to be connected to the front column. A rear end portion of the first reinforcement portion is bent outward in the width direction of the skeleton frame to be connected to the rear column.

In the storage box according to one or more embodiments of the present invention, a reinforcement rib that connects the first reinforcement portion and the outer peripheral rib forming the gouged portion is formed inside the first reinforcement portion.

In the storage box according to one or more embodiments of the present invention, a second reinforcement portion extending in the forward and rearward direction is formed in the bottom frame inside the first reinforcement portion in a width direction of the skeleton frame. The second reinforcement portion is formed in a groove shape that is elevated below the bottom frame and is open upward, and is formed to be continuous with the first reinforcement portion.

In the storage box according to one or more embodiments of the present invention, a third reinforcement portion that extends in a rightward and leftward direction to connect the pair of rear columns is formed in an outer peripheral portion on a rear side of the bottom frame, and the third reinforcement portion is formed in a groove shape that is elevated above the bottom frame and is open downward. A connection rib that connects the first reinforcement portion and the third reinforcement portion is formed in the skeleton frame.

In the storage box according to one or more embodiments of the present invention, a top plate is assembled to upper end portions of the front columns and upper end portions of the rear columns. Positions in a vertical direction of an opening end surface of the case body and a lower end surface of the top plate that is disposed on an upper side of the case body coincide with each other.

In the storage box according to one or more embodiments of the present invention, a plurality of the skeleton frames are assembled in a vertically stacked state. Positions in a vertical direction of an opening end surface of the case body and a lower end surface of the skeleton frame that is disposed on an upper side of the case body coincide with each other.

According to one or more embodiments of the present invention, while the ease of assembly can be improved, space in packaging form can be saved.

DETAILED DESCRIPTION OF THE INVENTION

Figure 1:
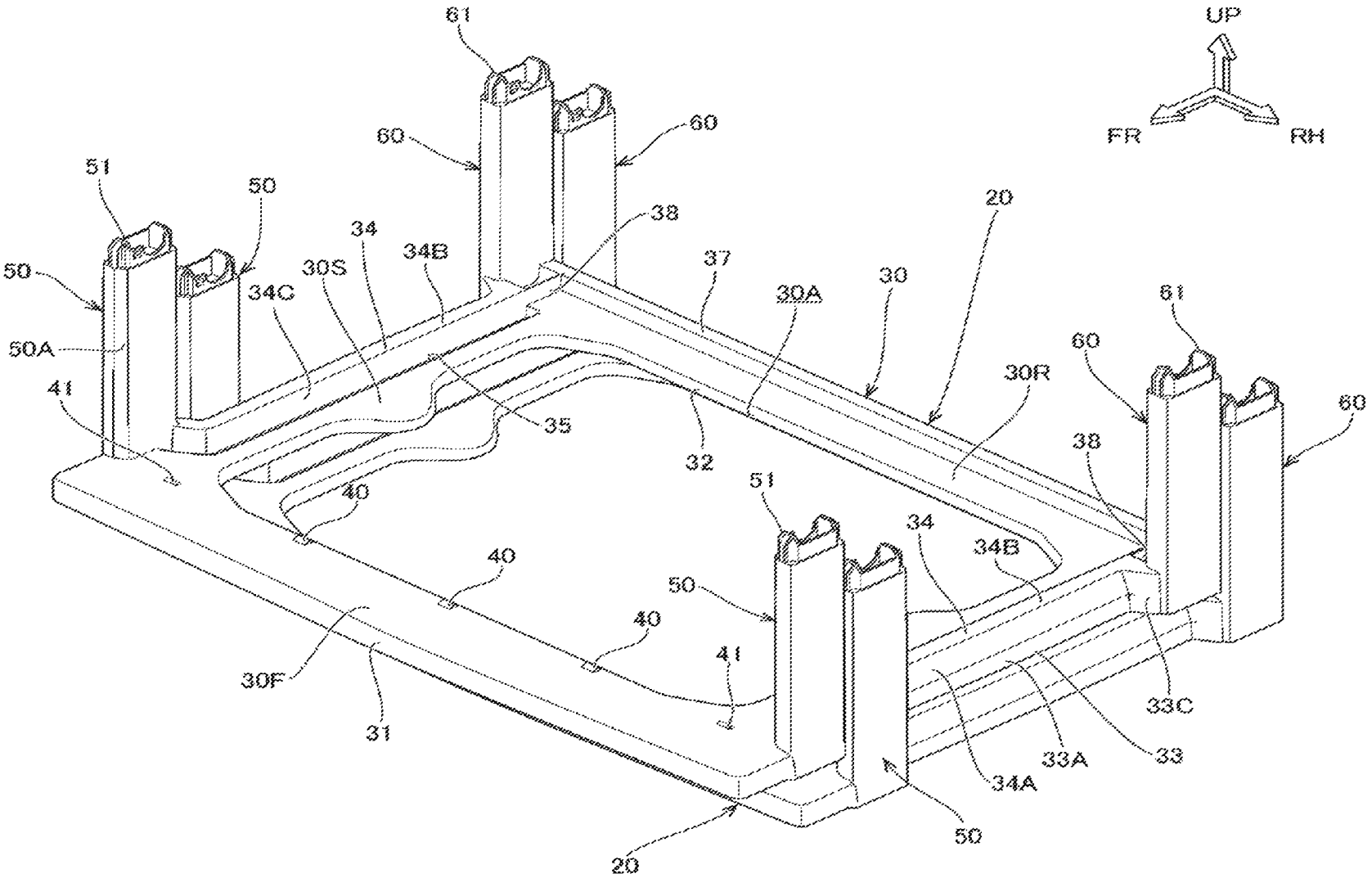
FIG. 1 is a perspective view illustrating a nested state of skeleton frames in a storage box according to the present embodiment as obliquely viewed from upper right.

Hereinafter, a storage box 10 according to the present embodiment will be described with reference to the drawings. Incidentally, arrow UP, arrow FR, and arrow RH appropriately illustrated in the drawings indicate an upper side, a front side, and a right side (one side of a width direction) of the storage box 10, respectively. In the following description, unless otherwise specified, vertical, forward and rearward, and rightward and leftward directions to be illustrated and described indicate a vertical direction, a forward and rearward direction, and a rightward and leftward direction of the storage box 10.

Regarding Entire Configuration of Storage Box

Figure 2:
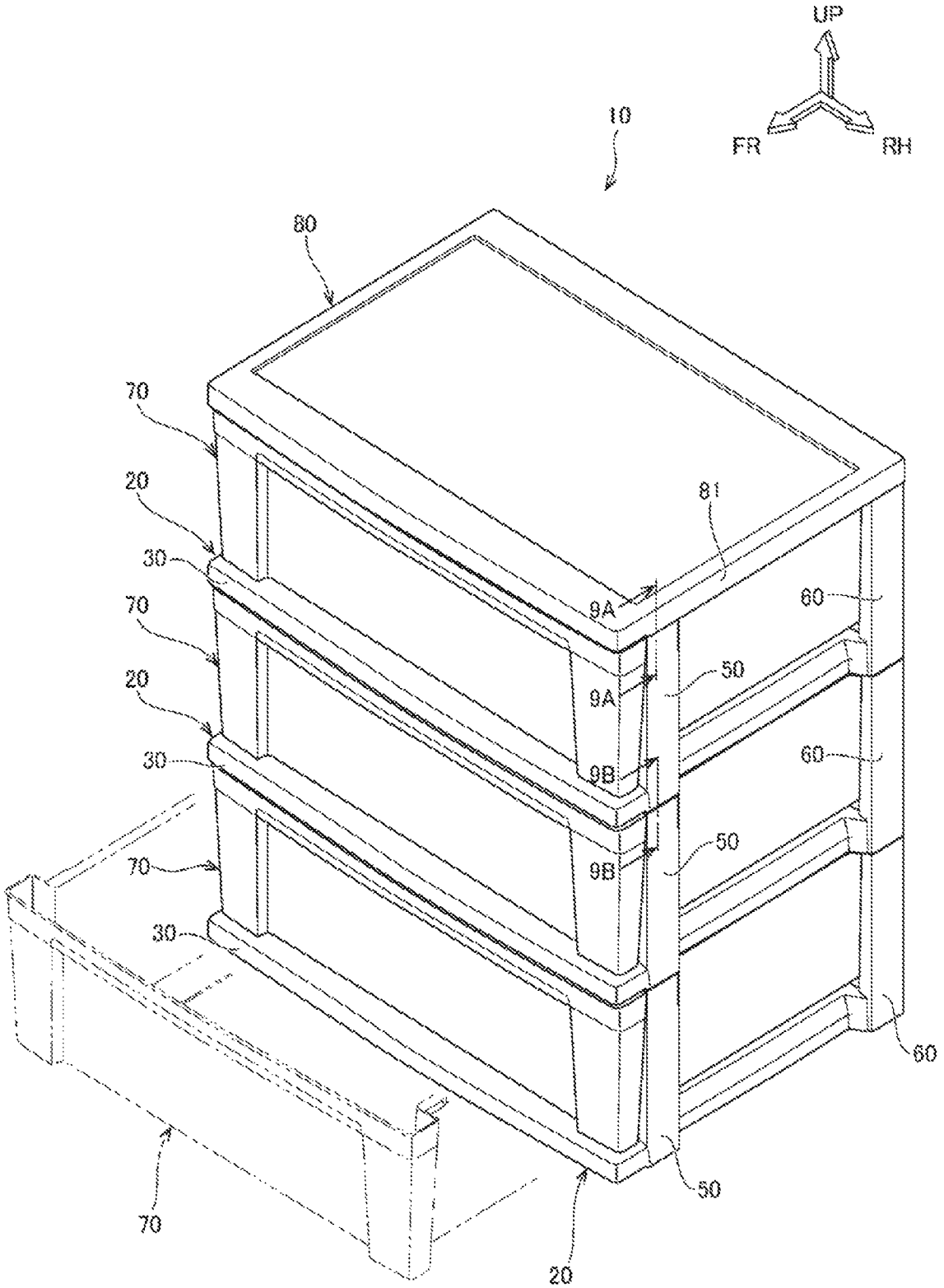
FIG. 2 is a perspective view illustrating the storage box according to the present embodiment as obliquely viewed from upper right.

As illustrated in FIG. 2, the storage box 10 is formed in a substantially rectangular parallelepiped shape as a whole. The storage box 10 is configured to include a plurality of (three in the present embodiment) skeleton frames 20 forming the skeleton of the storage box 10, a plurality of (three in the present embodiment) case bodies 70, and a top plate 80 forming an upper end portion of the storage box 10.

In the storage box 10, the plurality of skeleton frames 20 are assembled in a vertically stacked state, and the case body 70 is accommodated in each of the skeleton frames 20 so as to be slidable in the forward and rearward direction. The top plate 80 is assembled to the skeleton frame 20 in an uppermost stage to cover the case body 70, which is disposed in the uppermost stage, from above.

Incidentally, in the present embodiment, the storage box 10 has a configuration where the skeleton frames 20 are stacked in three stages; however, according to usage situations, the configuration may be such that the skeleton frames 20 are stacked in two or more stages, or the configuration may be such that the skeleton frame 20 is stacked in a single stage. Hereinafter, each configuration of the storage box 10 will be described.

Regarding Skeleton Frame

Figure 3:
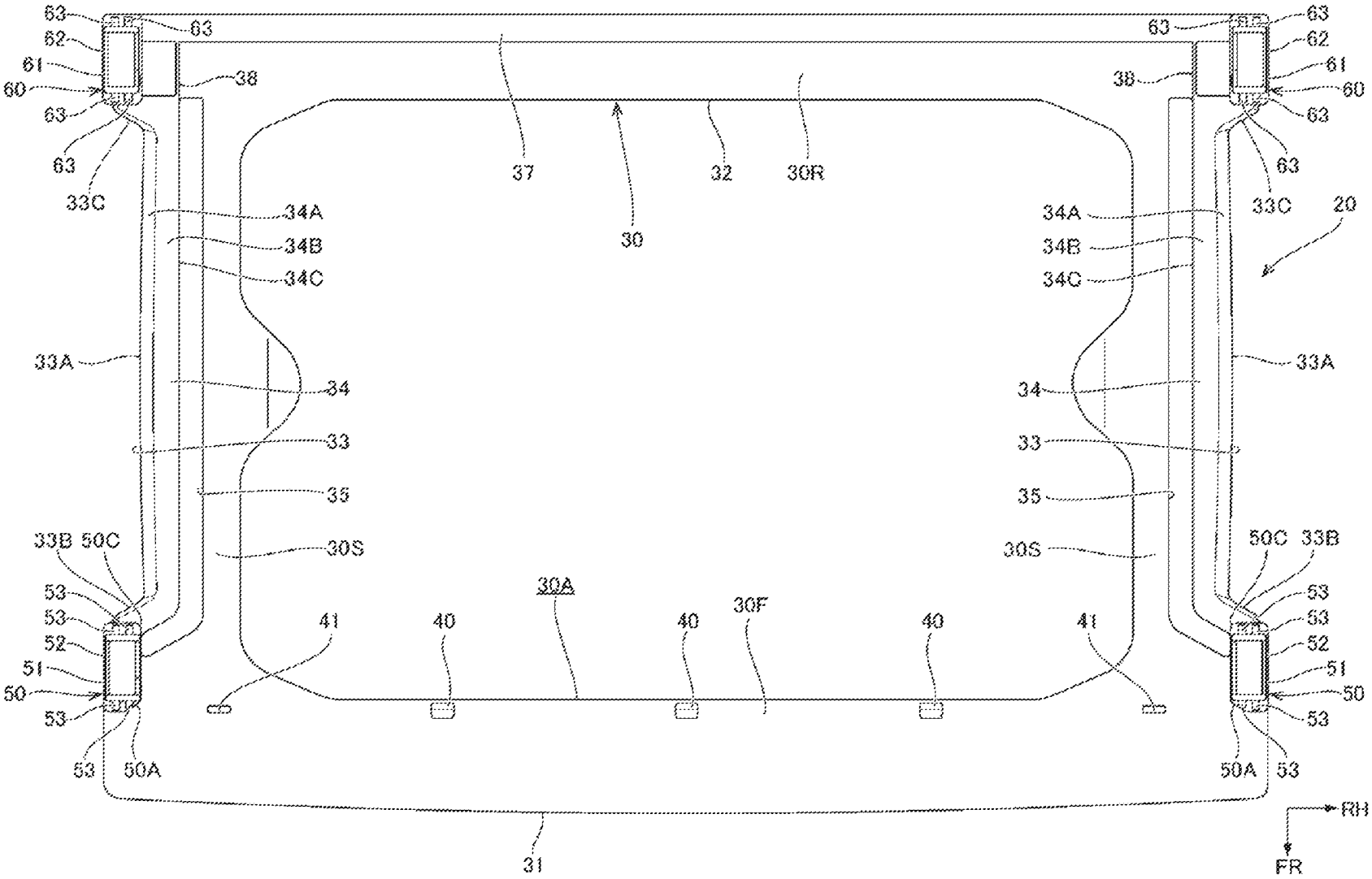
FIG. 3 is a plan view of the skeleton frame illustrated in FIG. 2 as viewed from above.
Figure 4:
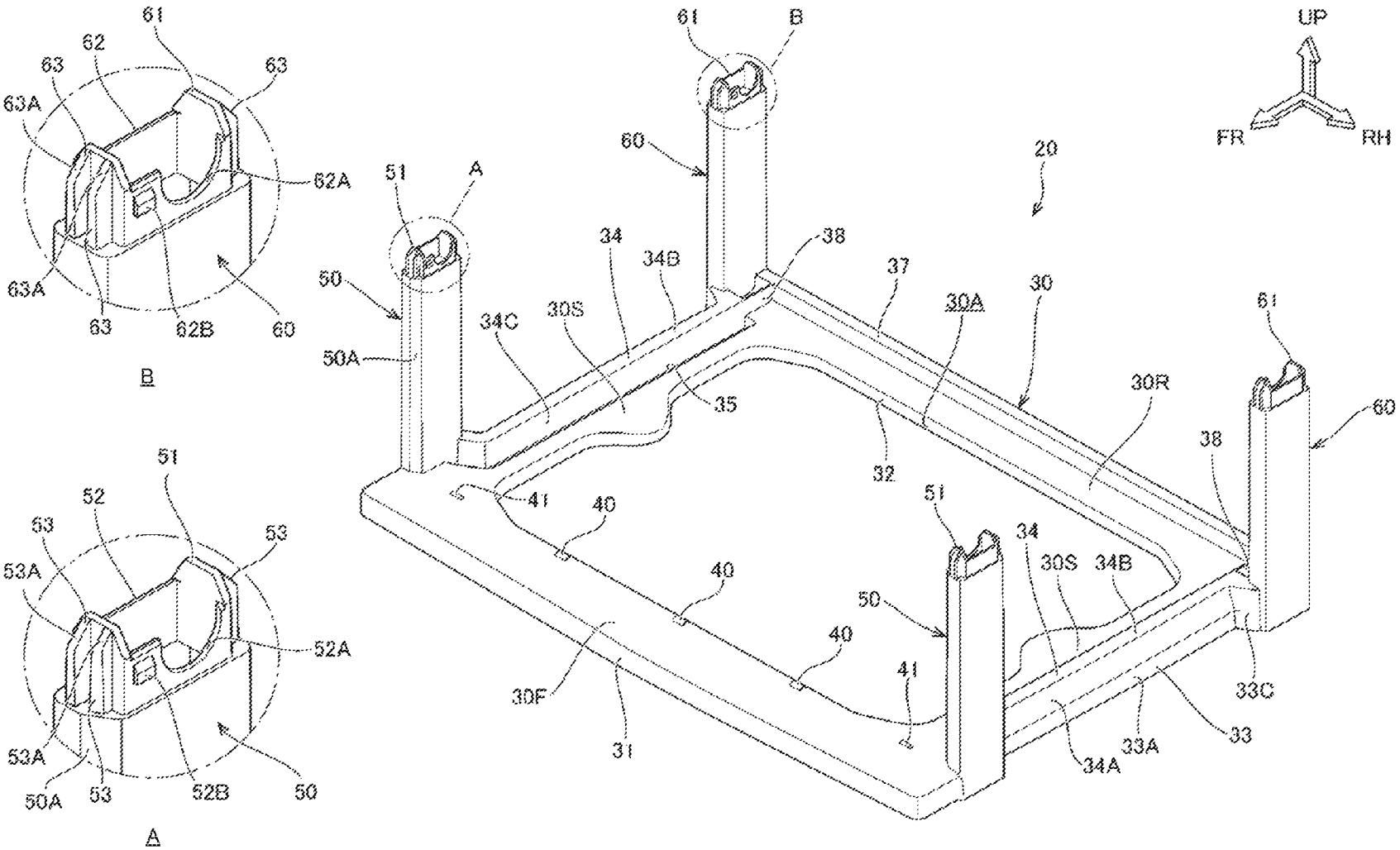
FIG. 4 is a perspective view of the skeleton frame illustrated in FIG. 3 as obliquely viewed from upper right.
Figure 5:
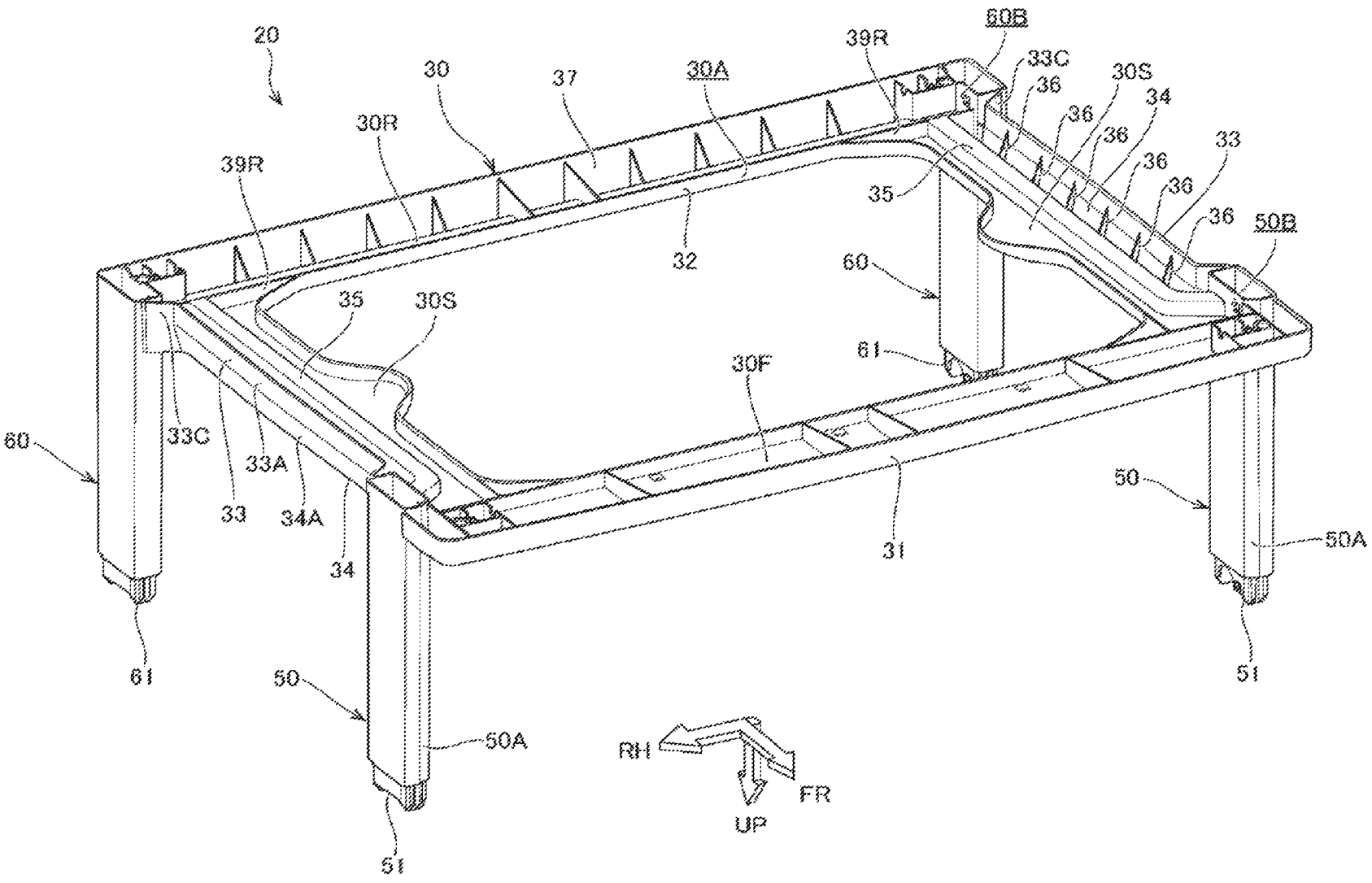
FIG. 5 is a perspective view of the skeleton frame illustrated in FIG. 3 as obliquely viewed from lower left.
Figure 6B:
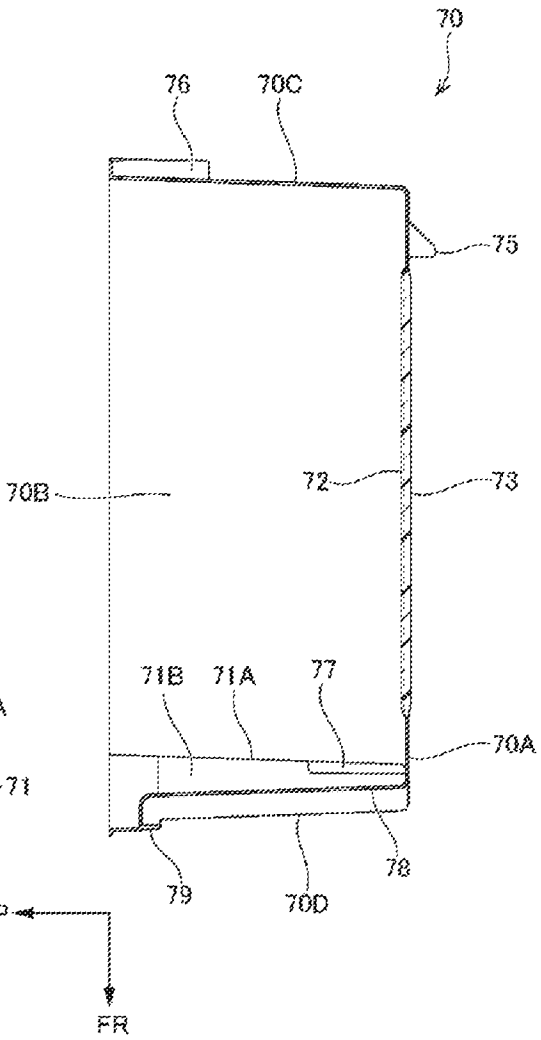
FIG. 6B is a side cross-sectional view of the case body of FIG. 6A as viewed from right (cross-sectional view along line 6B-6B of FIG. 6A).
Figure 6A:
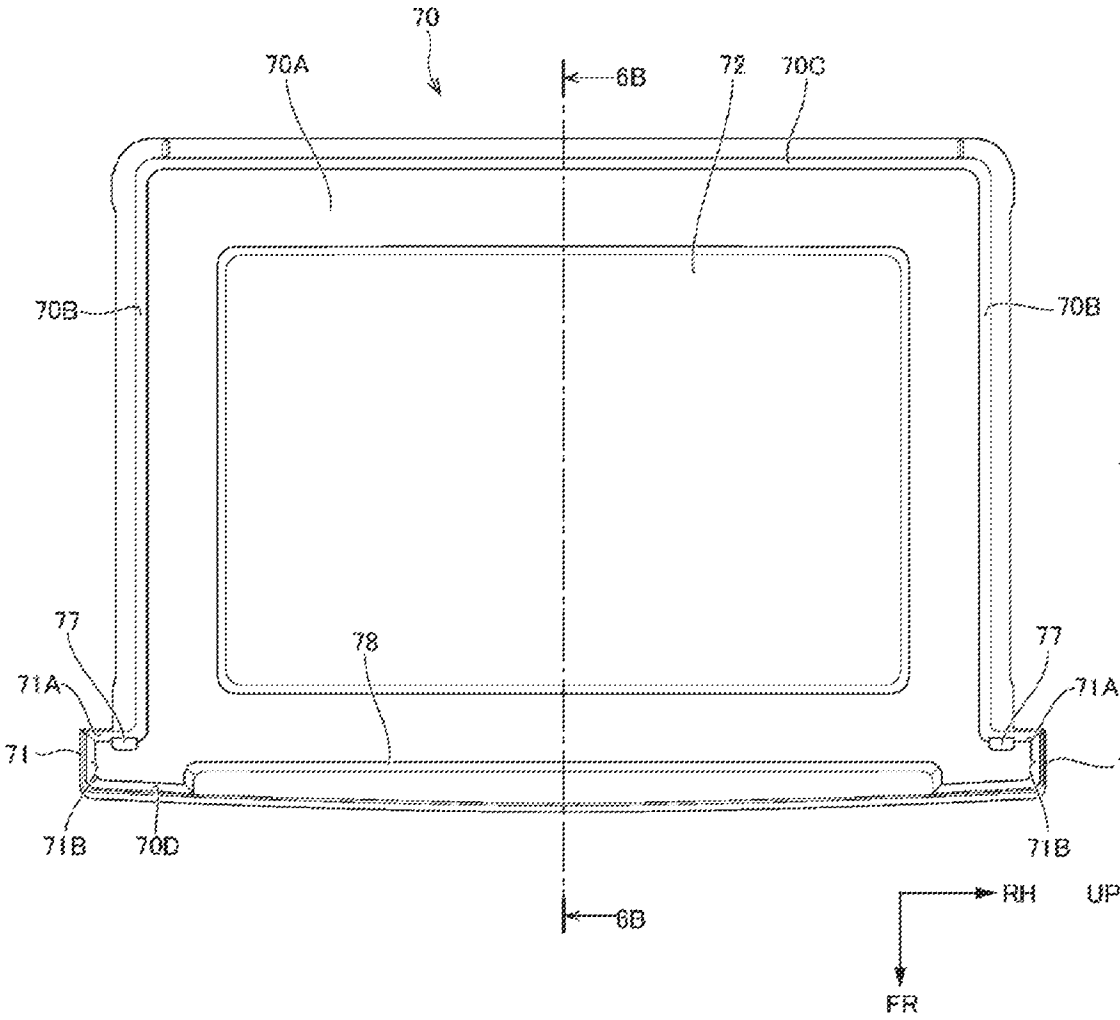
FIG. 6A is a plan view of a case body illustrated in FIG. 2 as viewed from above.
Figure 7A:
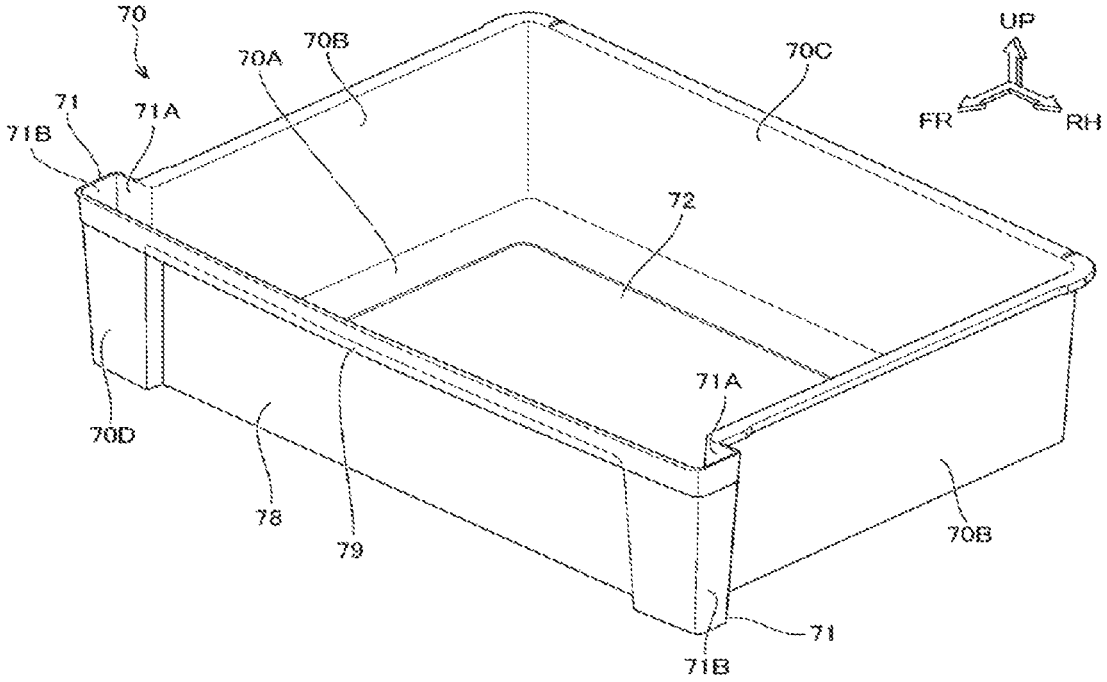
FIG. 7A is a perspective view of the case body illustrated in FIG. 6A as obliquely viewed from upper right.
Figure 7B:
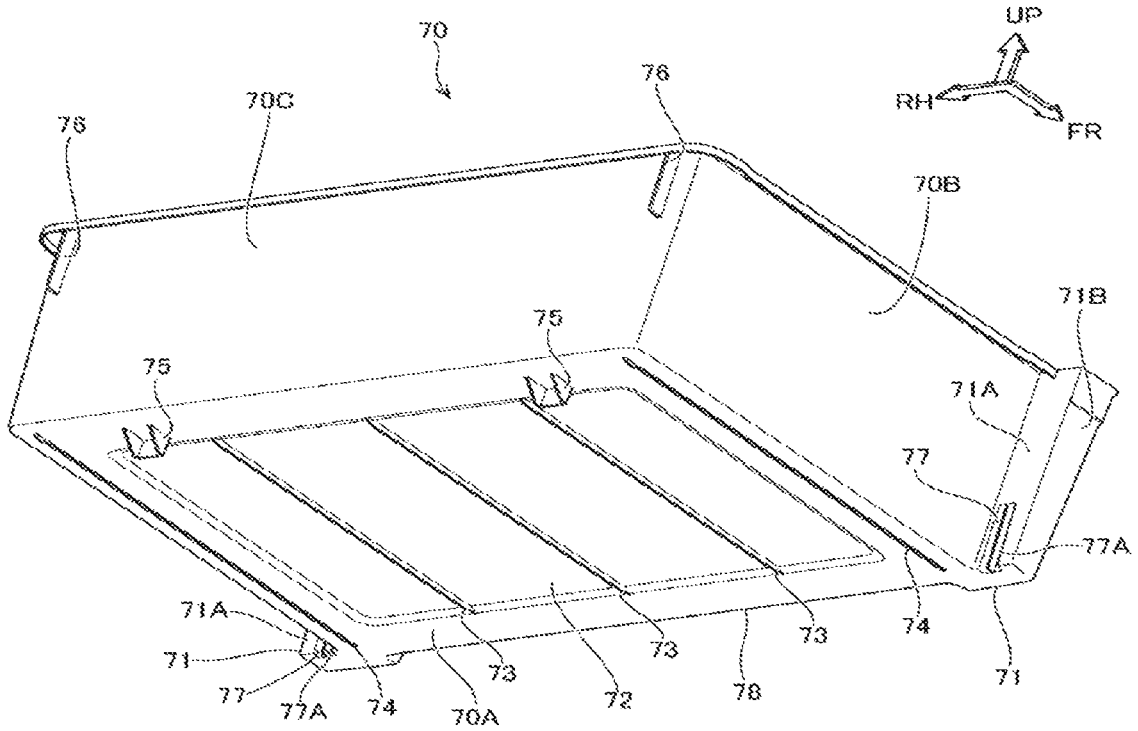
FIG. 7B is a perspective view of the case body illustrated in FIG. 6A as obliquely viewed from lower left.

As illustrated in FIGS. 3 to 5, the skeleton frame 20 is made of a resin material (polypropylene (PP) in the present embodiment). In addition, as will be described later in detail, in a state of the storage box 10 before assembly (disassembled state), the skeleton frame 20 is configured to be nestable, so that the skeleton frames 20 can be vertically stacked. The skeleton frame 20 is configured to include a boundary frame 30 as a "bottom frame" forming a bottom portion of the skeleton frame 20, and a pair of right and left front columns 50 and a pair of right and left rear columns 60 that extend upward from the boundary frame 30.

The boundary frame 30 is formed in a plate shape having the vertical direction as a plate thickness direction, and in a plan view viewed from above, is formed in a substantially rectangular frame shape having the rightward and leftward direction as a longitudinal direction. Accordingly, the boundary frame 30 is configured to include a front frame portion 30F that extends in the rightward and leftward direction to form a front end portion of the boundary frame 30, a rear frame portion 30R that extends in the rightward and leftward direction to form a rear end portion of the boundary frame 30, and a pair of right and left side frame portions 30S that extend in the forward and rearward direction to connect both end portions in the longitudinal direction of the front frame portion 30F and the rear frame portion 30R, and a hole portion 30A is formed inside the boundary frame 30. In addition, an outer peripheral rib 31 that is bent downward is formed at an outer peripheral edge of the boundary frame 30, and an inner peripheral rib 32 that is bent downward is formed at an inner peripheral edge of the boundary frame 30. The outer peripheral rib 31 and the inner peripheral rib 32 extend in a circumferential direction of the boundary frame 30. The positions in the vertical direction of a lower end of the outer peripheral rib 31 and a lower end of the inner peripheral rib 32 coincide with each other.

Here, before the boundary frame 30 will be described in detail, first, the front column 50 and the rear column 60 will be described. The front columns 50 are formed in a substantially bottomed rectangular cylinder shape that has the vertical direction as an axial direction and is open downward, and extend upward from both end portions in the width direction (rightward and leftward direction) of a front end side portion of the boundary frame 30. Accordingly, the front columns 50 form a part of the outermost shape on both sides in the width direction of the skeleton frame 20. In addition, a column side inclined surface 50A is formed in one (specifically, a corner disposed inward in the width direction of the boundary frame 30) of front corners of the front column 50. In a plan view, the column side inclined surface 50A is inclined rearward as the column side inclined surface 50A extends inward in the width direction of the boundary frame 30.

A front fitting portion 51 is formed in an upper end portion of the front column 50. The front fitting portion includes a fitting cylindrical portion 52, and the fitting cylindrical portion 52 is formed in a substantially rectangular cylinder shape having the vertical direction as an axial direction and protrudes upward from a top wall of the front column 50. In addition, the outer shape of the fitting cylindrical portion 52 in a plan view is set to be smaller than the outer shape of the front column 50, and the inside of the fitting cylindrical portion 52 and the inside of the front column 50 communicate with each other.

A cutout portion 52A is formed in one (specifically, a side wall disposed inward in the width direction of the boundary frame 30) of right and left side walls of the fitting cylindrical portion 52, and the cutout portion 52A is formed in a substantially semicircular shape that is open upward as viewed in the rightward and leftward direction. In addition, an engaging hook 52B is formed in front of the cutout portion 52A in the one of the right and left side walls of the fitting cylindrical portion 52, and the engaging hook 52B protrudes inward in the width direction of the boundary frame 30 from the side wall.

In addition, a pair of right and left fitting ribs 53 are formed on each of a front side and a rear side of the fitting cylindrical portion 52. Namely, four fitting ribs 53 are formed in the front fitting portion 51. The fitting rib 53 has the rightward and leftward direction as a plate thickness direction, and protrudes upward from the top wall of the front column 50 to be connected to the fitting cylindrical portion 52. Incidentally, a front surface of one (specifically, the fitting rib 53 disposed inward in the width direction of the boundary frame 30) of the pair of fitting ribs 53 that are disposed on the front side of the fitting cylindrical portion 52 is inclined to correspond to the column side inclined surface 50A of the front column 50. Furthermore, a rib inclined surface 53A is formed in an upper end portion of the fitting rib 53, and the rib inclined surface 53A is inclined toward a fitting cylindrical portion 52 side as the rib inclined surface 53A extends upward.

Figure 9A:
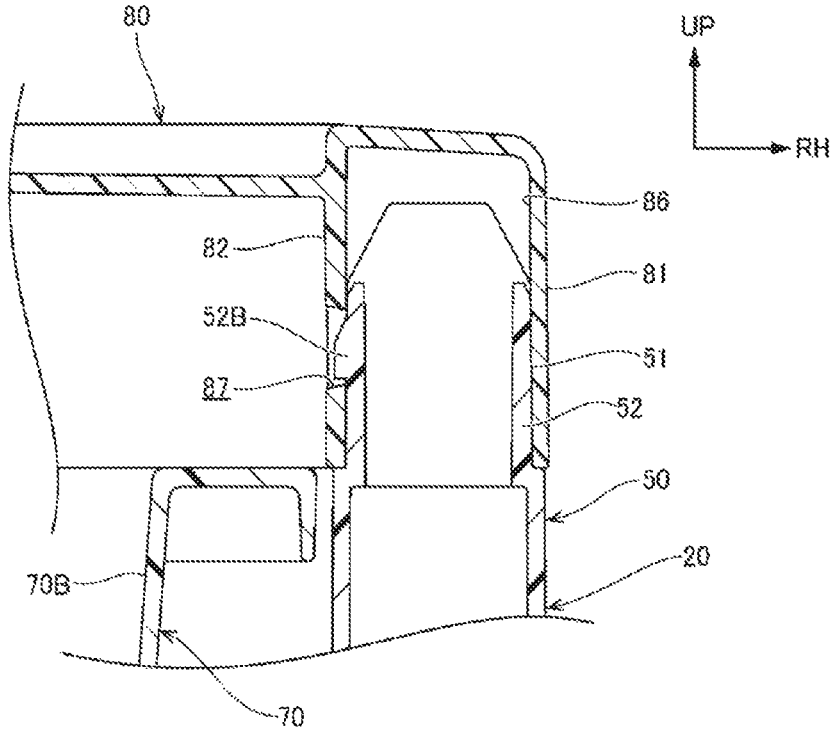
FIG. 9A is a cross-sectional view illustrating a connection state of a front column of the skeleton frame and the top plate illustrated in FIG. 2 as viewed from front (cross-sectional view along line 9A-9A of FIG. 2)
Figure 9B:
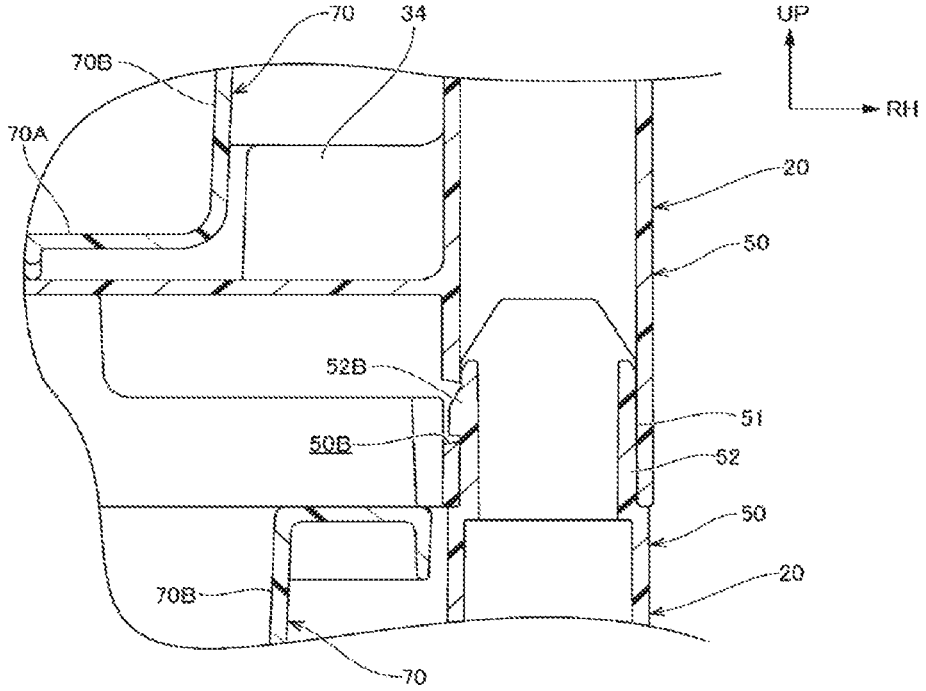
FIG. 9B is a cross-sectional view illustrating a connection state of the front columns of the skeleton frames illustrated in FIG. 2 as viewed from front (cross-sectional view along line 9B-9B of FIG. 2).

An engaging hole 50B (refer to FIG. 5) having a rectangular shape penetrates through one (specifically, a side wall disposed inward in the width direction of the boundary frame 30) of right and left side walls of a lower end portion of the front column 50. When the skeleton frames 20 are assembled in a vertically stacked state, the front fitting portions 51 of the skeleton frame 20 on the lower side are fitted into the lower end portions of the front columns 50 of the skeleton frame 20 on the upper side, and lower ends of the front columns 50 of the skeleton frame 20 on the upper side are placed on the top walls of the front columns 50 of the skeleton frame 20 on the lower side. In addition, at this time, the engaging hooks 52B of the skeleton frame 20 on the lower side are inserted into the engaging holes 50B of the skeleton frame 20 on the upper side, so that the skeleton frames 20 on the upper and lower sides are engaged with each other in the vertical direction (refer to FIG. 9B).

The rear columns 60 are formed in a substantially bottomed rectangular cylinder shape that has the vertical direction as an axial direction and is open downward, and extend upward from both rear corners of the boundary frame 30. Accordingly, the rear columns 60 form a part of the outermost shape on both sides in the width direction of the skeleton frame 20, together with the front columns 50. In addition, the rear column 60 is configured similar to the front column 50, except for the column side inclined surface 50A of the front column 50. Namely, the outer shape of the rear column 60 is a substantially rectangular shape, and the front column 50 and the rear column 60 have the same dimensions in the forward and rearward direction and the rightward and leftward direction (thickness direction). In addition, the positions in the rightward and leftward direction of the rear column 60 and the front column 50 that are aligned in the forward and rearward direction coincide with each other.

A rear fitting portion 61 is formed in an upper end portion of the rear column 60, and the rear fitting portion 61 is configured similar to the front fitting portion 51. Namely, the rear fitting portion 61 includes a fitting cylindrical portion 62 that has a substantially rectangular cylinder shape and protrudes upward from a top wall of the rear column 60. In addition, a cutout portion 62A that has a substantially semicircular shape and is open upward is formed in one of right and left side walls of the fitting cylindrical portion 62. Furthermore, an engaging hook 62B that protrudes inward in the width direction of the boundary frame 30 is formed in front of the cutout portion 62A in the one of the right and left side walls of the fitting cylindrical portion 62. Furthermore, a pair of right and left fitting ribs 63 are formed on each of a front side and a rear side of the fitting cylindrical portion 62, and a rib inclined surface 63A is formed in an upper end portion of the fitting rib 63.

Furthermore, similar to the front column 50, an engaging hole 60B (refer to FIG. 5) having a rectangular shape penetrates through one of right and left side walls of a lower end portion of the rear column 60. When the skeleton frames 20 are assembled in a vertically stacked state, the rear fitting portions 61 of the skeleton frame on the lower side are fitted into the lower end portions of the rear columns 60 of the skeleton frame 20 on the upper side, and lower ends of the rear columns 60 of the skeleton frame 20 on the upper side are placed on the top walls of the rear columns 60 of the skeleton frame on the lower side. In addition, at this time, the engaging hooks 62B of the skeleton frame 20 on the lower side are inserted into the engaging holes 60B of the skeleton frame 20 on the upper side, so that the skeleton frames 20 on the upper and lower sides are engaged with each other in the vertical direction.

Returning to the description of the boundary frame 30, gouged portions 33 are formed in side portions (namely, the outer peripheral rib 31 of the side frame portions 30S) on both sides in the width direction of the boundary frame 30 at positions between the front columns 50 and the rear columns 60. The gouged portion 33 is formed in a recessed shape that is open outward in the width direction of the boundary frame 30 and extends in the forward and rearward direction, and is depressed (recessed) inward in the width direction from the outermost shape in the width direction of the boundary frame 30. Namely, the outer peripheral rib 31 forming the gouged portions 33 is bent in a recessed shape that is open outward in the width direction of the boundary frame 30. In addition, a front opening end of the gouged portion 33 is connected to a rear surface of the front column 50, and a rear opening end of the gouged portion 33 is connected to a front surface of the rear column 60. Accordingly, the gouged portions 33 extend in the forward and rearward direction over the entire portions between the front columns 50 and the rear columns 60 in both side portions in the width direction of the boundary frame 30.

Bottom surfaces (namely, surfaces that form side surfaces on both sides in the width direction of the boundary frame 30) of the gouged portions 33 are formed as curved surfaces 33A, and in a plan view, the curved surface 33A is curved in an arc shape that is gently convex outward in the width direction of the boundary frame 30. Specifically, the curved surface 33A is gently curved such that a central portion in the forward and rearward direction of the curved surface 33A is a top of the curved surface 33A. A front inclined surface 33B and a rear inclined surface 33C, which will be described later, are connected to ends in the forward and rearward direction of the curved surface 33A, and the top of the curved surface 33A is curved outward in a range of 1 mm to 5 mm, preferably 1.5 mm to 2 mm with respect to the ends of the curved surface 33A which does not include the front inclined surface 33B and the rear inclined surface 33C. In addition, the curved surfaces 33A are disposed at positions that are offset inward in the width direction of the boundary frame 30 by substantially the same amount as the thickness of the front column 50 and the rear column 60 with respect to the outermost shape on both sides in the width direction of the skeleton frame 20. In other words, the front columns 50 and the rear columns 60 are offset outward in the width direction of the boundary frame 30 by substantially the same amount as the thickness of the front column 50 and the rear column 60 with respect to the curved surfaces 33A.

Figure 11:
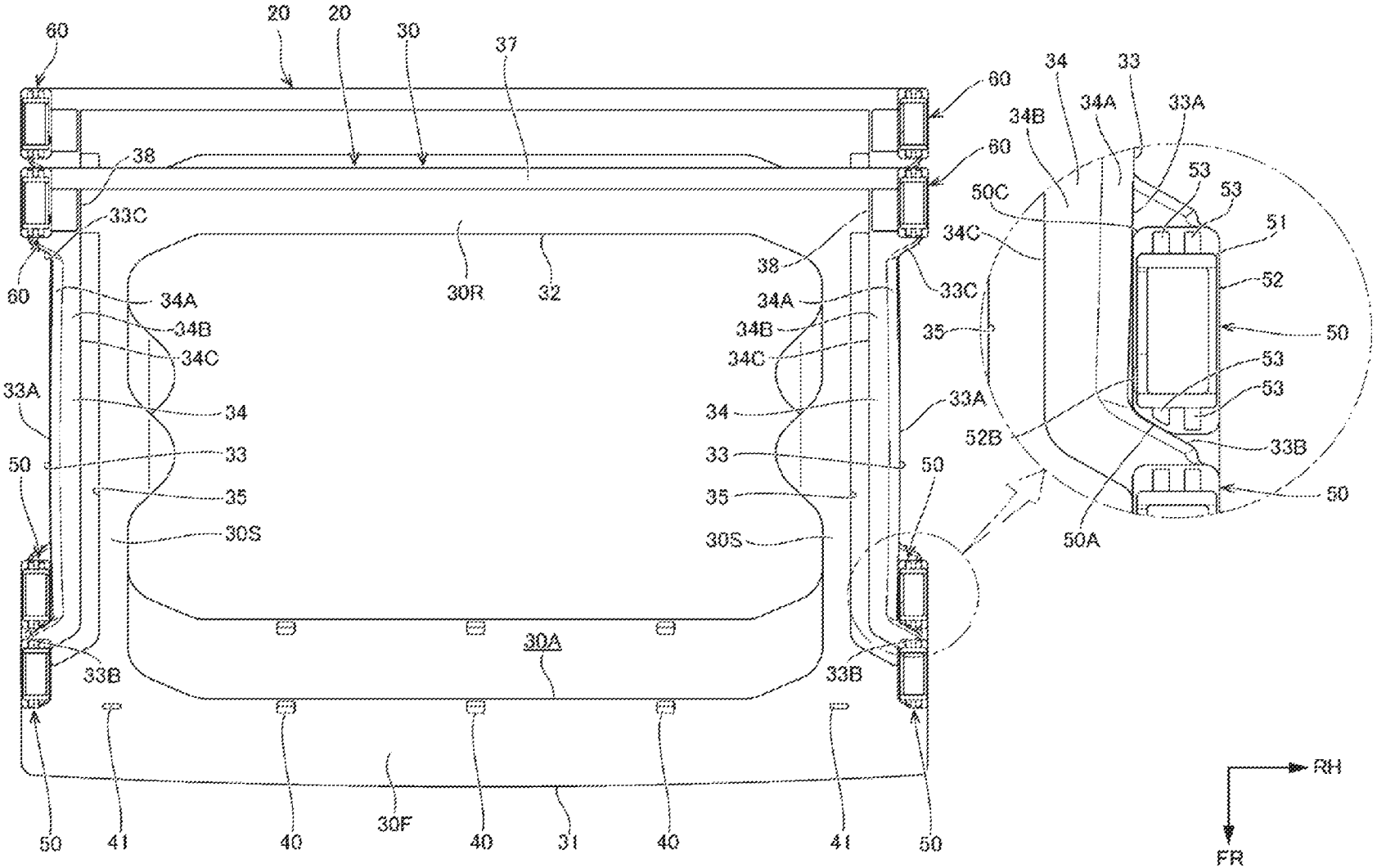
FIG. 11 is a plan view illustrating a nested state of the skeleton frames illustrated in FIG. 1 as viewed from above.

As will be described later in detail, when the skeleton frames 20 are nested, lower end side portions of the front columns 50 of the skeleton frame 20 on the lower side are disposed in front end portions of the gouged portions 33 of the skeleton frame 20 on the upper side, and are disposed adjacent to the curved surfaces 33A on the outside in the width direction of the skeleton frame 20 (refer to FIGS. 1 and 11). Furthermore, in this state, a corner 50C on a rear side (specifically, a corner on the rear side which is disposed inward in the width direction of the boundary frame 30) of the front column 50 of the skeleton frame 20 on the lower side is in contact with the curved surface 33A of the skeleton frame 20 on the upper side (refer to FIG. 11). Namely, the top of the curved surface 33A of the skeleton frame 20 on the upper side is disposed closer to the rear side than the front column 50 of the skeleton frame 20 on the lower side.

A front end side surface of the gouged portion 33 is formed as the front inclined surface 33B, and the front inclined surface 33B extends forward from a front end of the curved surface 33A to be connected to the rear surface of the front column 50. In addition, in a plan view, the front inclined surface 33B is inclined outward in the width direction of the boundary frame 30 as the front inclined surface 33B extends forward. Furthermore, the inclination angle of the front inclined surface 33B with respect to the rightward and leftward direction is set to coincide with the inclination angle of the column side inclined surface 50A of the front column 50 with respect to the rightward and leftward direction. When the skeleton frames 20 are nested, the column side inclined surfaces 50A of the front columns 50 of the skeleton frame on the lower side are in contact with the front inclined surfaces 33B of the gouged portions 33 of the skeleton frame 20 on the upper side (refer to FIG. 11).

A rear end side surface of the gouged portion 33 is formed as the rear inclined surface 33C, and the rear inclined surface 33C extends rearward from a rear end of the curved surface 33A to be connected to the front surface of the rear column 60. In addition, in a plan view, the rear inclined surface 33C is inclined outward in the width direction of the skeleton frame 20 as the rear inclined surface 33C extends rearward.

Figure 10:
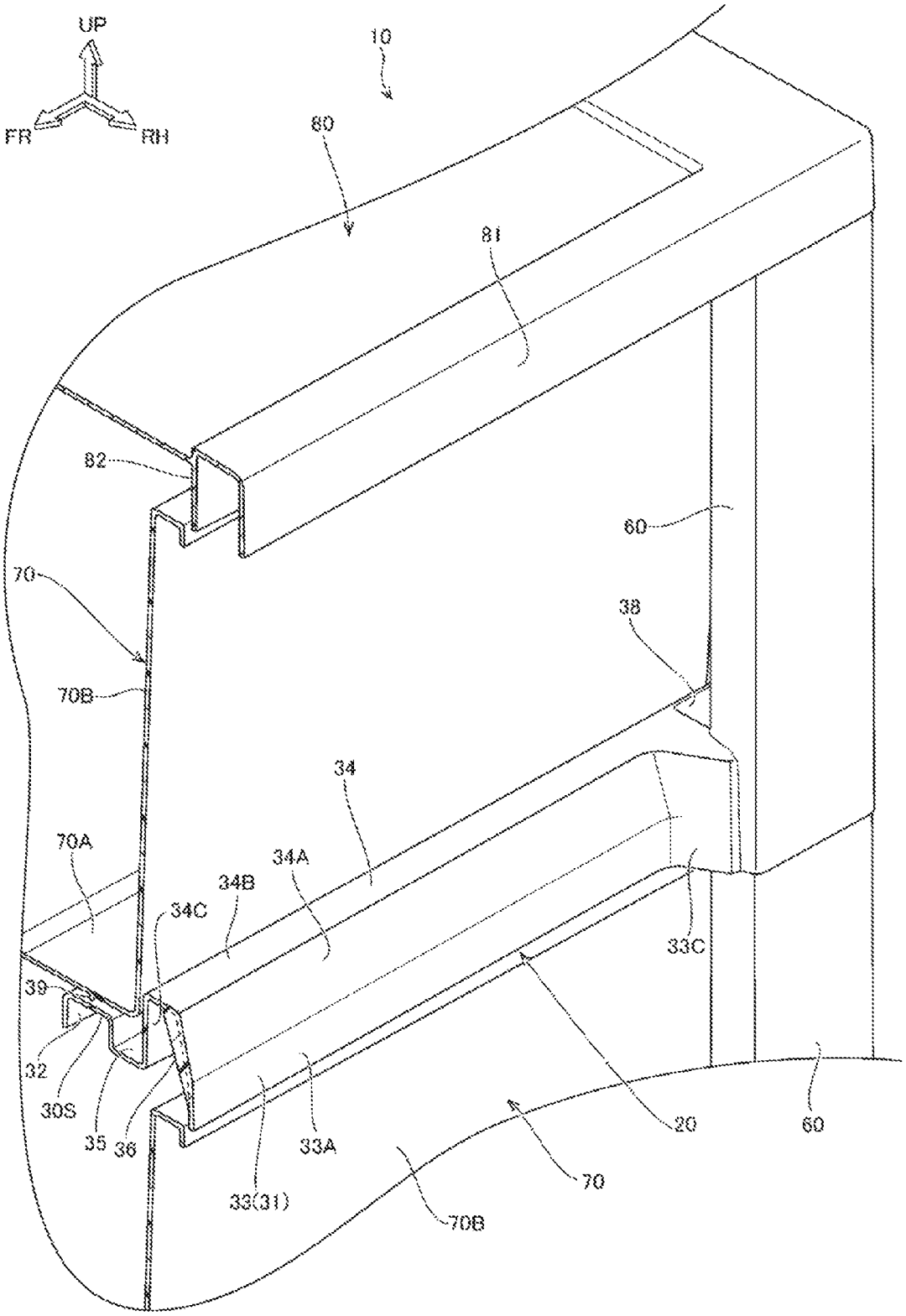
FIG. 10 is a perspective view illustrating a right side portion of the storage box illustrated in FIG. 2 in a state the right side portion is partially cut away.

As illustrated in FIG. 10, a first reinforcement portion 34 extending in the forward and rearward direction is formed in an outer peripheral portion of the side frame portion 30S of the boundary frame 30. The first reinforcement portion 34 is elevated upward with respect to the boundary frame 30, and as viewed in a longitudinal direction of the first reinforcement portion 34, is formed in a substantially inverted U-shaped groove shape that is open downward. The first reinforcement portion 34 is formed to be continuous with the outer peripheral rib 31 forming the gouged portions 33. Specifically, the first reinforcement portion 34 is configured to include an outer reinforcement wall 34A that extends upward from an upper end portion of the outer peripheral rib 31 forming the gouged portions 33, a top wall 34B that extends inward in the width direction of the boundary frame 30 from an upper end portion of the outer reinforcement wall 34A, and an inner reinforcement wall 34C that extends downward from an inner end portion of the top wall 34B in the width direction of the boundary frame 30.

In addition, the outer reinforcement wall 34A of the first reinforcement portion 34 is slightly inclined inward in the width direction of the boundary frame 30 as the outer reinforcement wall 34A extends upward. Furthermore, in a plan view, the outer reinforcement wall 34A is formed in a recessed shape that is open outward in the width direction of the boundary frame 30 to correspond to the shape of the gouged portion 33. Namely, a front end portion and a rear end portion of the outer reinforcement wall 34A is inclined to correspond to the front inclined surface 33B and the rear inclined surface 33C of the gouged portion 33.

In a plan view, the front end portion of the first reinforcement portion 34 is inclined outward in the width direction of the boundary frame 30 as the front end portion extends forward, to be connected to a rear end portion of the front column 50. In addition, in a plan view, the rear end portion of the first reinforcement portion 34 is bent outward in the width direction of the skeleton frame 20 to be connected to a front end portion of the rear column 60.

A second reinforcement portion 35 extending in the forward and rearward direction is formed in the side frame portion 30S at a position that is adjacent to the inside of the first reinforcement portion 34 in the width direction of the boundary frame 30. The second reinforcement portion 35 is elevated downward with respect to the boundary frame 30, and as viewed in a longitudinal direction of the second reinforcement portion 35, is formed in a substantially U-shaped groove shape that is open upward. The second reinforcement portion 35 is formed to be continuous with the first reinforcement portion 34 (the inner reinforcement wall 34C of the first reinforcement portion 34) such that an outer peripheral side portion of the side frame portion 30S is formed in an uneven shape in a cross-sectional view in the forward and rearward direction.

Incidentally, in a plan view, a front end portion of the second reinforcement portion 35 is inclined outward in the width direction of the boundary frame 30 as the front end portion extends forward, to be connected to the lower end portion of the front column 50. In addition, the position in the forward and rearward direction of a rear end portion of the second reinforcement portion 35 coincides with the position in the forward and rearward direction of the rear end portion of the first reinforcement portion 34.

In addition, a plurality of (six in the present embodiment) reinforcement ribs 36 are formed inside a pair of the first reinforcement portions 34 on a back surface of the boundary frame 30, respectively. The reinforcement ribs 36 are formed in a substantially triangular plate shape having the forward and rearward direction as a plate thickness direction, and are disposed at a predetermined interval in the forward and rearward direction. The reinforcement ribs 36 extend downward from the top wall 34B of the first reinforcement portion 34 to connect the top wall 34B and the outer peripheral rib 31 that forms the outer reinforcement wall 34A of the first reinforcement portion 34 and the curved surface 33A (refer to FIG. 10).

A third reinforcement portion 37 extending in the rightward and leftward direction is formed in an outer peripheral portion of the rear frame portion 30R of the boundary frame 30. The third reinforcement portion 37 is elevated upward with respect to the boundary frame 30, and as viewed in a longitudinal direction of the third reinforcement portion 37, is formed in a substantially inverted U-shaped groove shape that is open downward. The outer peripheral rib 31 on the rear side of the boundary frame 30 extends upward to form a rear wall of the third reinforcement portion 37. In addition, both end portions in the longitudinal direction of the third reinforcement portion 37 are connected to the rear end portions of the pair of right and left rear columns 60, so that the pair of right and left rear columns 60 are connected to each other by the third reinforcement portion 37.

Furthermore, a pair of right and left connection ribs 38 extending in the forward and rearward direction are formed on an upper surface of the boundary frame 30 at positions between the first reinforcement portions 34 and the third reinforcement portion 37. The connection rib 38 is formed in a substantially rectangular plate shape having the rightward and leftward direction as a plate thickness direction, and extends rearward from a rear end portion of the inner reinforcement wall 34C of the first reinforcement portion 34. The rear end portions of the first reinforcement portions 34 (inner reinforcement walls 34C) and both end portions in the longitudinal direction of the third reinforcement portion 37 are connected to each other by the connection ribs 38. Accordingly, reinforcement ribs that are formed of the first reinforcement portions 34 (inner reinforcement walls 34C) and the connection ribs 38 are formed linearly along the forward and rearward direction on both side portions in the width direction of the boundary frame 30 to be connected to the third reinforcement portion 37.

In addition, a pair of right and left side ribs 39R (refer to FIG. 5) that extend inward in the width direction of the boundary frame 30 from the lower end portions of the rear columns 60 are formed on the back surface of the boundary frame 30. The side rib 39R is formed in a substantially rectangular plate shape having the forward and rearward direction as a plate thickness direction, and a tip portion of the side rib 39R is connected to the inner peripheral rib 32 on a rear side of the boundary frame 30. Accordingly, reinforcement ribs that are formed of the side ribs 39R and the inner peripheral rib 32 on the rear side are formed linearly along the rightward and leftward direction in the rear end portion of the boundary frame 30 to be connected to the pair of right and left rear columns 60.

A plurality of (three in the present embodiment) first sliding protrusions 40 are formed on an upper surface of the front frame portion 30F of the boundary frame 30 in front of the hole portion 30A, and the first sliding protrusions 40 are disposed to be aligned at a predetermined interval in the rightward and leftward direction. The first sliding protrusion 40 is formed in a substantially triangular shape as viewed in the rightward and leftward direction, and extends in the rightward and leftward direction. In addition, a top of the first sliding protrusion 40 is curved in a substantially arc shape that is convex upward.

A pair of right and left second sliding protrusions may be further formed outside the first sliding protrusions 40 in the width direction of the boundary frame 30 on upper surfaces of the side frame portions 30S of the boundary frame 30. When the second sliding protrusion 41 is provided, the second sliding protrusion is formed in a substantially semi-circular shape as viewed in the rightward and leftward direction, and extends in the rightward and leftward direction.

Regarding Case Body

As illustrated in FIGS. 2, 6A, 6B, and 7, the case body 70 is made of a resin material (polypropylene (PP) in the present embodiment). The case body 70 is formed in a substantially rectangular box shape that is open upward. Specifically, the case body 70 is configured to include a bottom wall 70A having a substantially rectangular plate shape that has the vertical direction as a plate thickness direction and has the rightward and leftward direction as a longitudinal direction, a pair of right and left side walls 70B that extend upward from both end portions in the width direction (rightward and leftward direction) of the bottom wall 70A, a rear wall 70C that extends upward from a rear end portion of the bottom wall 70A, and a front wall 70D that extends upward from a front end portion of the bottom wall 70A.

In addition, a pair of right and left extension portions 71 extending outward in a width direction of the case body 70 are formed in front end portions of the side walls 70B. Namely, first extension wall members 71A that are bent outward in the width direction of the case body and second extension wall members 71B that extend forward from tip portions of the first extension wall members 71A to be connected to both end portions in the width direction of the front wall 70D are formed in the front end portions of the side walls 70B. The dimension in the rightward and leftward direction of a portion of the case body 70, which does not include the extension portions 71, is set to be slightly smaller than a distance in the rightward and leftward direction between the pair of first reinforcement portions 34 of the skeleton frame 20. The case body 70 is accommodated in the skeleton frame 20 so as to be slidable in the forward and rearward direction. Specifically, the case body 70 is configured to slide between an accommodation position (position indicated by a solid line in FIG. 2) where the case body 70 is accommodated in the skeleton frame 20 and a pullout position (position indicated by a two-dot chain line in FIG. 2) where the case body 70 is pulled out forward from the accommodation position.

Incidentally, when the case body 70 is at the accommodation position, the extension portions 71 of the case body 70 are disposed adjacent to the front side of the front columns 50 of the skeleton frame 20, and the case body 70 at the accommodation position is restricted from moving rearward. In addition, when the case body 70 is at the accommodation position, the first reinforcement portions 34 of the skeleton frame 20 are disposed adjacent to the outsides in the width direction of lower end portions of the side walls 70B of the case body 70. Accordingly, when the case body 70 slides between the accommodation position and the pullout position, the first reinforcement portions 34 guide the case body 70.

In addition, the height of the case body 70 is set such that, when the case body 70 is accommodated in the skeleton frame 20, the vertical position of an opening end surface (upper end surface) of the case body 70 coincides with the vertical position of a lower end surface of the skeleton frame 20 (outer peripheral rib 31 of the skeleton frame 20) disposed above the case body 70 (refer to FIG. 10).

Furthermore, the case body 70 has a nestable configuration where the case bodies 70 are vertically stacked when the storage box 10 is in a disassembled state. Namely, the side walls 70B, the rear wall 70C, and the front wall 70D of the case body 70 are inclined toward the inside of the case body 70 as the side walls 70B, the rear wall 70C, and the front wall 70D extend downward. In addition, the inclination angle of the side wall 70B with respect to the vertical direction is set to be larger than the inclination angle of the second extension wall member 71B with respect to the vertical direction. Therefore, when the case body 70 is accommodated in the skeleton frame 20, in a front view, side surfaces of the case body (side surfaces of the second extension wall members 71B) are disposed substantially along the vertical direction. In addition, the inclination angle of the front wall 70D with respect to the vertical direction is set to be smaller than that of the rear wall 70C with respect to the vertical direction. Accordingly, the case bodies 70 can be nested, and when the case bodies 70 are accommodated in the skeleton frames 20, in a front view, the design of the storage box 10 can be improved.

A drawn portion 72 that is elevated upward is formed in the bottom wall 70A of the case body 70, and in a plan view, the drawn portion 72 is formed in a substantially rectangular shape having the rightward and leftward direction as a longitudinal direction. In addition, a plurality of (three in the present embodiment) first sliding ribs 73 are formed in a portion, in which the drawn portion 72 is formed, on a lower surface of the bottom wall 70A. The first sliding rib 73 extends in the forward and rearward direction, and is disposed at a position corresponding to the first sliding protrusion 40 of the skeleton frame 20. In addition, a lower end portion of the first sliding rib 73 protrudes slightly further downward than the lower surface of the bottom wall 70A. When the case body 70 slides in the forward and rearward direction, the lower end portions of the first sliding ribs 73 slide on the first sliding protrusions 40 of the skeleton frame 20.

In addition, a pair of right and left second sliding ribs 74 are formed outside the drawn portion 72 in the width direction of the case body 70 on the lower surface of the bottom wall 70A. The second sliding rib 74 extends in the forward and rearward direction, and is disposed at a position corresponding to the second sliding protrusion 41 of the skeleton frame 20. A rear end portion of the second sliding rib 74 protrudes slightly further downward than other portions of the second sliding rib 74, and as viewed in the rightward and leftward direction, a lower end portion of the rear end portion of the second sliding rib 74 is formed in a substantially arc shape that is convex downward. When the case body 70 is in the accommodation position, front end portions of the second sliding ribs 74 are placed on the second sliding protrusions 41 of the skeleton frame 20, and the rear end portions of the second sliding ribs 74 are placed on the upper surface of the boundary frame 30 (side frame portions 30S) of the skeleton frame 20. When the case body 70 slides in the forward and rearward direction, the lower end portions of the second sliding ribs 74 slide on the second sliding protrusions 41 of the skeleton frame 20.

In addition, a pair of right and left stoppers 75 are formed in a rear end portion of the bottom wall 70A of the case body 70. The stoppers 75 protrude downward from the bottom wall 70A, and are disposed in the hole portion 30A of the skeleton frame 20. In a bottom view viewed from below, the stopper 75 is formed in a substantially U-shaped plate shape that is open rearward. When the case body 70 is pulled out to the pullout position, front surfaces of the stoppers 75 come into contact with the inner peripheral rib 32 on a front side of the hole portion 30A of the skeleton frame 20. Accordingly, the case body 70 at the pullout position is restricted from moving forward.

A pair of right and left leg pieces 76 are formed in both end portions in the width direction of an upper end portion of the rear wall 70C of the case body 70. The leg piece 76 is formed in a substantially rectangular plate shape that has the rightward and leftward direction as a plate thickness direction and extends in the vertical direction, and protrudes rearward from the rear wall 70C. When the case bodies 70 are nested, a lower end of the leg piece 76 of the case body 70 on the upper side is placed on the opening end surface of the case body 70 on the lower side.

A pedestal portion 77 is formed in a lower end portion of the first extension wall member 71A of the side wall 70B of the case body 70. The pedestal portion 77 extends upward from the bottom wall 70A, and is formed in a recessed shape that is open rearward and downward. A pedestal rib 77A is formed inside the pedestal portion 77, and the pedestal rib 77A is formed in a plate shape having the rightward and leftward direction as a plate thickness direction and extends in the vertical direction. When the case bodies 70 are nested, lower ends of the pedestal portions 77 (pedestal ribs 77A) of the case body 70 on the upper side are placed on upper end surfaces of the pedestal portions 77.

A recessed portion 78 that is elevated rearward is formed in a portion of the front wall 70D of the case body 70, the portion not including both end portions in the width direction of the front wall 70D, and the recessed portion 78 is open forward and downward. In addition, a handle piece 79 extending downward is formed in front of an upper end portion of the recessed portion 78 in the front wall 70D. The handle piece 79 is formed in a substantially long plate shape that has the forward and rearward direction as a plate thickness direction and extends the rightward and leftward direction, and is disposed forward away from the upper end portion of the recessed portion 78. Accordingly, a space is formed between the handle piece 79 and the upper end portion of the recessed portion 78. A user grips the handle piece 79 to cause the case body 70 to slide forward and rearward.

Regarding Top Plate

Figure 8:
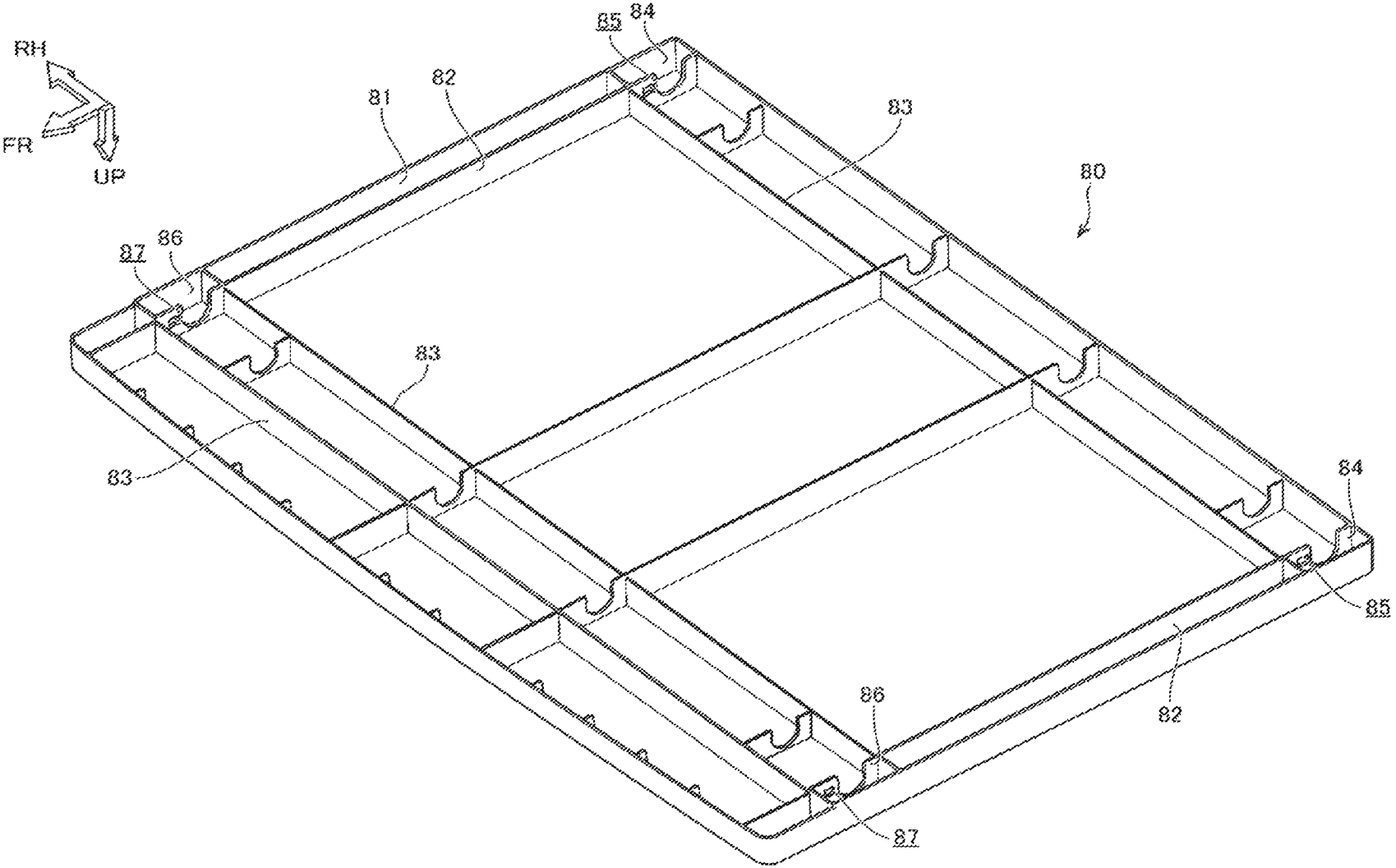
FIG. 8 is a perspective view of a top plate illustrated in FIG. 2 as obliquely viewed from lower right.

As illustrated in FIGS. 2 and 8, the top plate 80 is formed in a substantially rectangular plate shape that has the vertical direction as a plate thickness direction and has the rightward and leftward direction as a longitudinal direction. In addition, an outer peripheral wall 81 that is bent downward is formed at an outer peripheral edge of the top plate 80, and the outer peripheral wall 81 is formed over the entire periphery in a circumferential direction of the top plate 80. A pair of right and left first ribs 82 extending in the forward and rearward direction are formed in both end portions in the width direction (rightward and leftward direction) of a lower surface of the top plate 80. The first rib 82 is formed in a long plate shape having the rightward and leftward direction as a plate thickness direction, and both end portions in a longitudinal direction of the first rib 82 are connected to the outer peripheral wall 81. In addition, three second ribs 83 extending in the rightward and leftward direction are formed on the lower surface of the top plate 80. The second rib 83 is formed in a long plate shape having the forward and rearward direction as a plate thickness direction, and both end portions in a longitudinal direction of the second rib 83 are connected to the outer peripheral wall 81.

In addition, one second rib 83 is disposed in a rear end portion of the top plate 80. Accordingly, rear side fitting portions 84 that are formed by the outer peripheral wall 81, the first rib 82, and the second rib 83 are formed in rear corners of the top plate 80, and the rear side fitting portions 84 are formed in a substantially rectangular cylinder shape. The rear side fitting portions 84 are formed to correspond to the rear fitting portions 61 of the skeleton frame 20, and the rear fitting portions 61 are fitted into the rear side fitting portions 84, so that the top plate 80 is assembled to the skeleton frame 20 in the uppermost stage. Incidentally, an engaging hole 85 into which the engaging hook 52B of the skeleton frame 20 is inserted penetrates through the first rib 82 of the rear side fitting portion 84.

In addition, two second ribs 83 are disposed away from each other in the forward and rearward direction in a front end side portion of the top plate 80. Accordingly, front side fitting portions 86 that are formed by the outer peripheral wall 81, the first rib 82, and the two second ribs 83 are formed in both end portions in the width direction of the front end side portion of the top plate 80, and the front side fitting portions 86 are formed in a substantially rectangular cylinder shape. The front side fitting portions 86 are formed to correspond to the front fitting portions 51 of the skeleton frame 20, and the front fitting portions 51 are fitted into the front side fitting portions 86, so that the top plate 80 is assembled to the skeleton frame 20 in the uppermost stage (refer to FIG. 9A). Incidentally, an engaging hole 87 into which the engaging hook 52B of the skeleton frame 20 is inserted penetrates through the first rib 82 of the front side fitting portion 86.

In addition, the length of extension of the outer peripheral wall 81, the first rib 82, and the second ribs 83 from the top plate 80 is set such that, when the top plate 80 is assembled to the skeleton frame 20 in the uppermost stage, the vertical position of a lower end surface of the top plate 80 (lower end surfaces of the outer peripheral wall 81, the first rib 82, and the second ribs 83) coincides with the vertical position of the opening end surface (upper end surface) of the case body 70 in the uppermost stage. Namely, the lower end surface of the outer peripheral wall 81 of the top plate 80 and the opening end surface of the case body 70 in the uppermost stage are disposed to be flush with each other (refer to FIG. 10).

Effects

Next, the effects of the present embodiment will be described with a description of a procedure for nesting the skeleton frames 20 and a packaging form of the storage box 10 when the storage box 10 is in a disassembled state.

Regarding Nesting of Skeleton Frames

When a plurality of the skeleton frames 20 are nested, the other skeleton frame 20 is disposed above one skeleton frame 20. At this time, the skeleton frame 20 on the upper side is disposed to be offset forward by the dimension in the forward and rearward direction of the front column 50 (rear column 60) with respect to the skeleton frame 20 on the lower side. Accordingly, in a plan view, the front columns 50 of the skeleton frame 20 on the lower side are disposed to overlap the front end portions of the gouged portions 33 of the skeleton frame 20 on the upper side. In this state, the skeleton frame 20 on the upper side is moved downward, so that the upper end portions of the front columns 50 of the skeleton frame on the lower side are inserted into the front end portions of the gouged portions 33 of the skeleton frame 20 on the upper side. Then, the skeleton frame 20 on the upper side is further moved downward, so that the lower ends of the gouged portions 33 (outer peripheral rib 31) of the skeleton frame 20 on the upper side are placed on the top walls 34B of the first reinforcement portions 34 of the skeleton frame 20 on the lower side. Accordingly, as illustrated in FIGS. 1 and 11, the nesting of the skeleton frames 20 is completed.

In addition, when the skeleton frames 20 are nested, the front columns 50 of the skeleton frame 20 on the upper side are disposed adjacent to the front side of the front columns 50 of the skeleton frame 20 on the lower side. Furthermore, in this state, the curved surfaces 33A of the skeleton frame 20 on the upper side are in contact with the corners 50C on the rear side (specifically, boundary portions between the side surfaces of the front columns 50 and the corners 50C) of the front columns 50 of the skeleton frame 20 on the lower side.

Regarding Packaging Form of Storage Box

Next, a packaging form of the storage box 10 during transport or the like will be described. Incidentally, in the present embodiment, the storage box 10 has a form where the skeleton frames 20 are stacked in three stages, and packaging forms of the storage box 10 in a form where the skeleton frames 20 are stacked in four stages, five stages, and six stages will be also described.

Figure 12B:
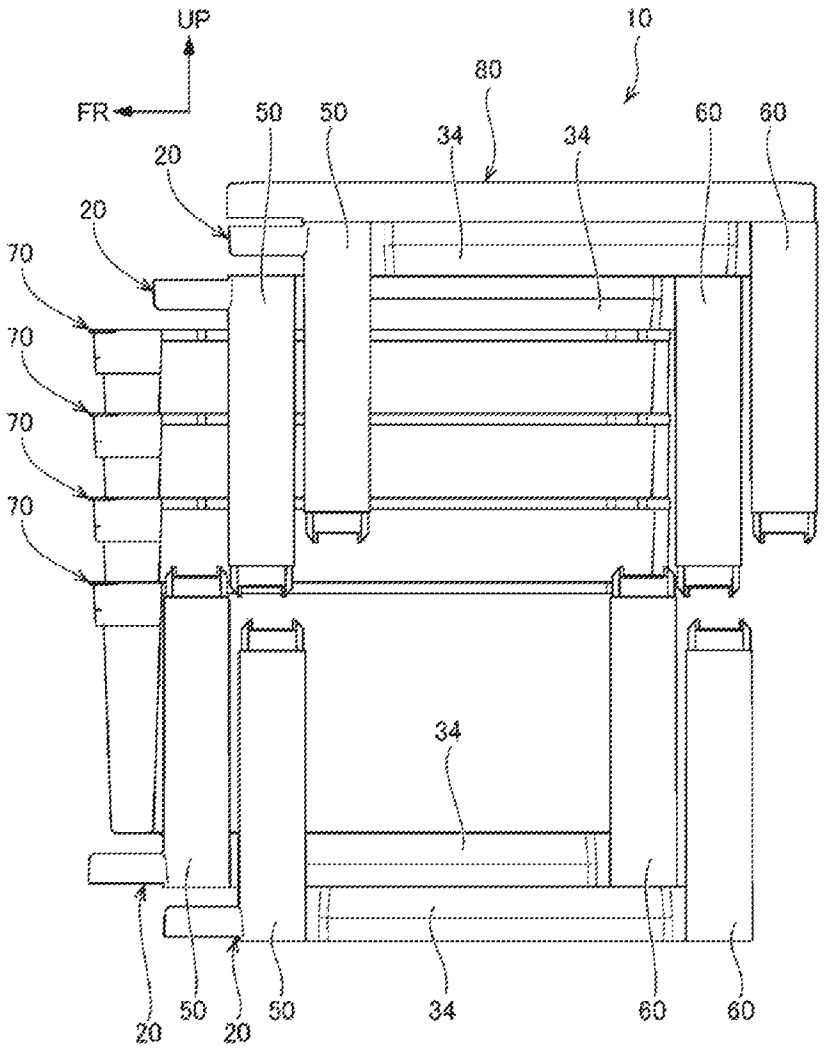
FIG. 12B is a side view illustrating a packaging form of the storage boxes in four stages.
Figure 12A:
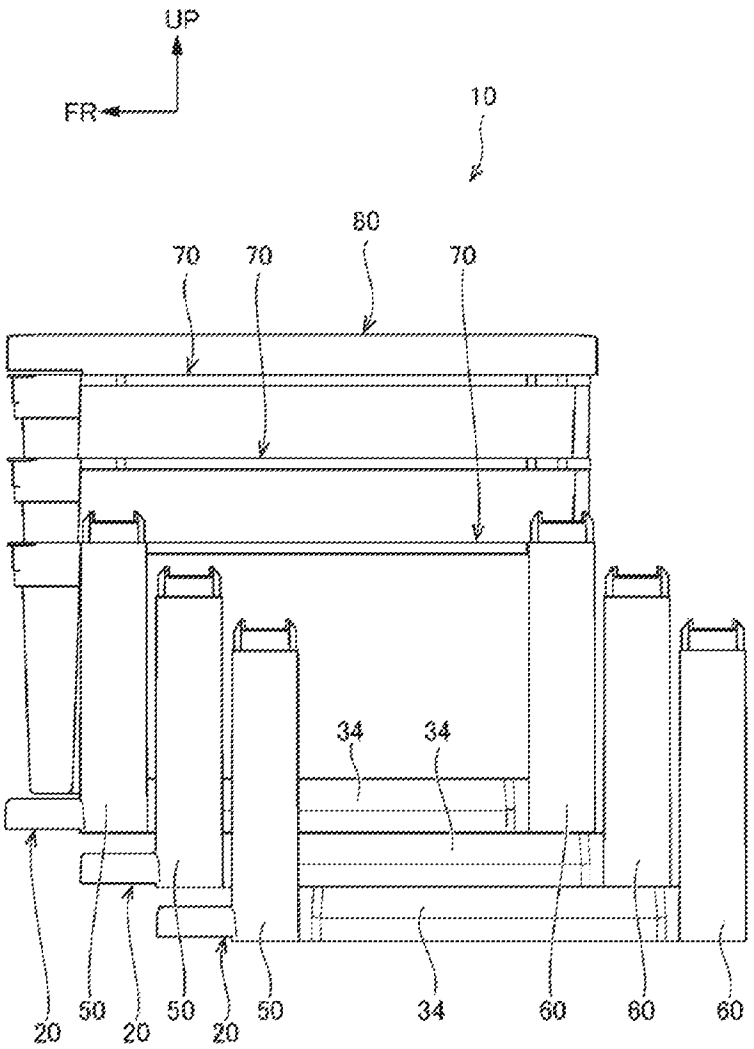
FIG. 12A is a side view illustrating a packaging form of the storage box illustrated in FIG. 2.

As illustrated in FIG. 12A, when the storage box 10 is packaged in three stages, three skeleton frames 20 are vertically stacked and nested according to the above-described procedure. In addition, three case bodies 70 are vertically stacked and nested. Then, the case bodies 70 nested in three stages are accommodated in the skeleton frame 20 nested in the uppermost stage. Furthermore, the top plate 80 is disposed on the opening end surface of the case body 70 nested in the uppermost stage. As described above, the packaging form of the storage box 10 in three stages is the form illustrated in FIG. 12A.

As illustrated in FIG. 12B, when the storage box 10 is packaged in four stages, two skeleton frames 20 are vertically stacked and nested according to the above-described procedure. In addition, four case bodies 70 are vertically stacked and nested. Then, the case bodies 70 nested in four stages are accommodated in the skeleton frame 20 nested in the uppermost stage.

In this state, one of the remaining skeleton frames 20 is turned upside down and placed on the case body 70 in the uppermost stage. Specifically, while the case bodies 70 nested are inserted into the skeleton frame 20, the top walls 34B of the first reinforcement portions 34 of the skeleton frame 20 are placed on the opening end surface of the case body 70 in the uppermost stage. In addition, in this state, the skeleton frame 20 is placed on the case body 70 such that the front columns 50 of the skeleton frame 20 placed on the case body 70 are disposed at positions close to the rear side of the front columns 50 of the skeleton frame 20 in a lowermost stage.

Then, the remaining skeleton frame 20 is turned upside down and nested in the skeleton frame 20 placed on the case body 70. Specifically, the remaining skeleton frame 20 is nested to be offset rearward by the dimension in the forward and rearward direction of the front column 50 with respect to the skeleton frame 20 placed on the case body 70. Furthermore, the top plate 80 is placed on the skeleton frame 20 nested in the uppermost stage. As described above, the packaging form of the storage box 10 in four stages is the form illustrated in FIG. 12B.

Namely, in the packaging form of the storage box 10 in four stages, the skeleton frames 20 nested in two stages, the case bodies 70 nested in four stages, the skeleton frames 20 nested in two stages in a turned upside down state, and the top plate 80 are stacked in order from below.

Figure 13B:
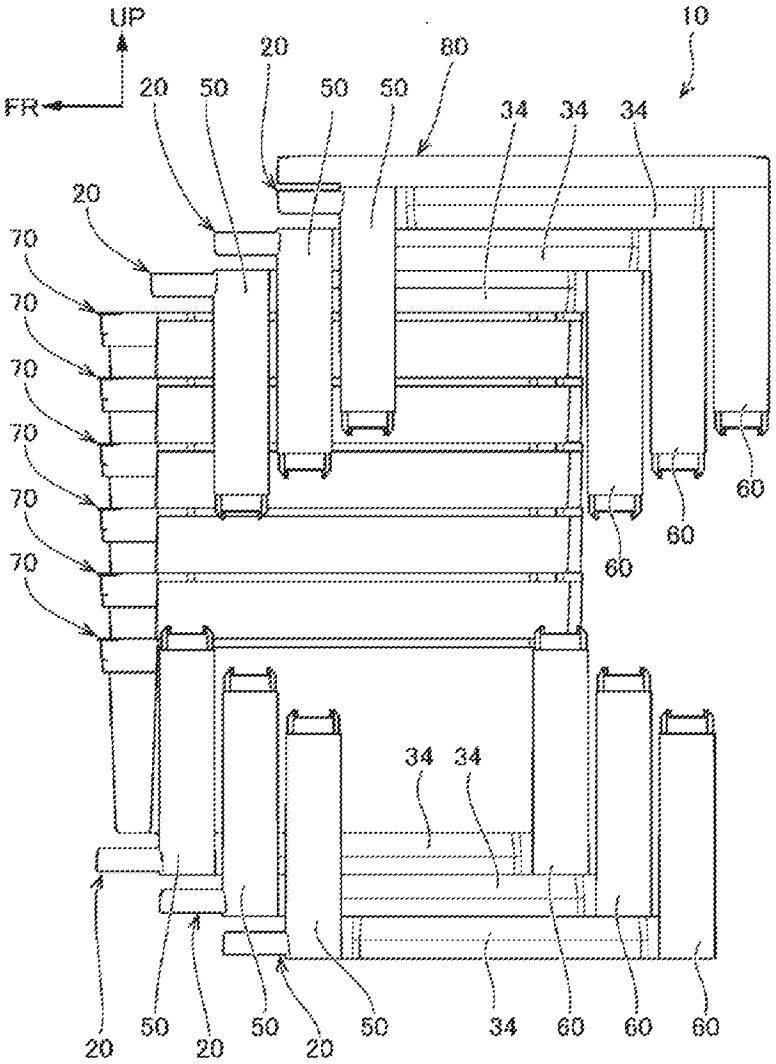
FIG. 13B is a side view illustrating a packaging form of the storage boxes in six stages.
Figure 13A:
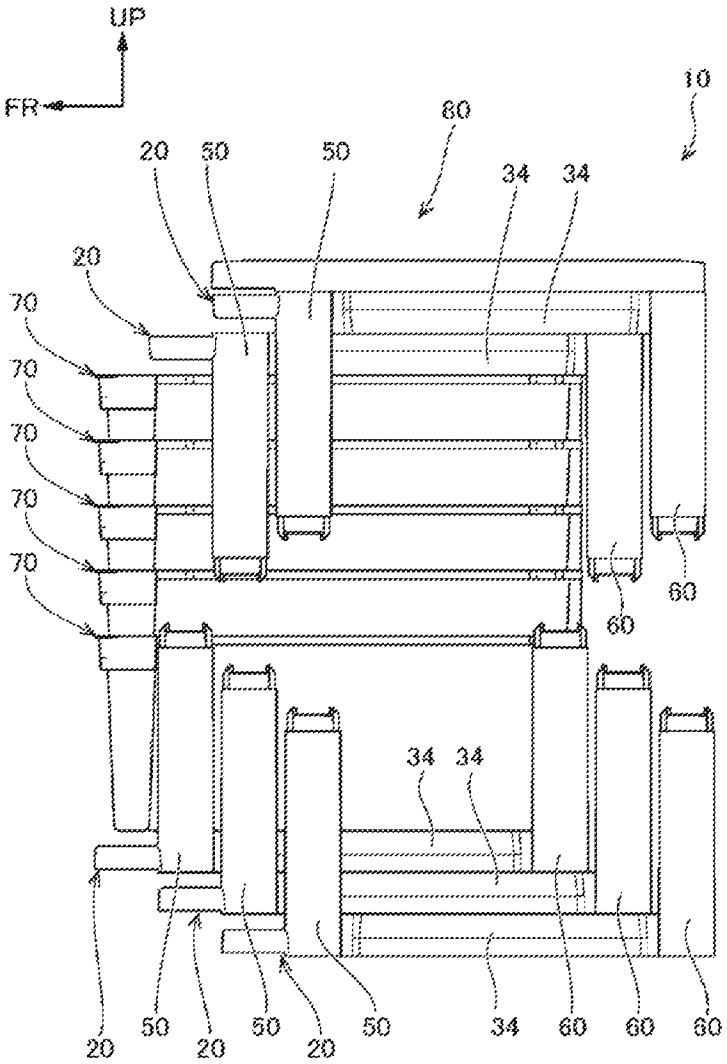
FIG. 13A is a side view illustrating a packaging form of the storage boxes in five stages.

As illustrated in FIG. 13A, the packaging of the storage box 10 in five stages is performed according to the same procedure as when the storage box 10 is packaged in four stages, but the number of nesting stages of the skeleton frames 20 on the lower side on which the case bodies 70 nested in five stages are placed is 3. Namely, in the packaging form of the storage box 10 in five stages, the skeleton frames 20 nested in three stages, the case bodies 70 nested in five stages, the skeleton frames 20 nested in two stages in a turned upside down state, and the top plate 80 are stacked in order from below.

As illustrated in FIG. 13B, the packaging of the storage box 10 in six stages is performed according to the same procedure as when the storage box 10 is packaged in five stages, but the number of nesting stages of the skeleton frames 20 on the upper side which are to be placed on the case bodies 70 nested in six stages is 3. Namely, in the packaging form of the storage box 10 in six stages, the skeleton frames 20 nested in three stages, the case bodies 70 nested in six stages, the skeleton frames 20 nested in three stages in a turned upside down state, and the top plate 80 are stacked in order from below.

As described above, when the storage box 10 is packaged in four or more stages, the skeleton frames 20 are divided into two sets of the skeleton frames 20 in a nested state, and the case bodies 70 nested are vertically interposed between the divided sets of skeleton frames 20 in a nested state. Therefore, an increase in packaging space in the forward and rearward direction of the storage box 10 can be further suppressed than a packaging form where the skeleton frames 20 are not divided into two sets of the skeleton frames 20 in a nested state.

Here, in the skeleton frame 20 of the storage box 10, the boundary frame 30 forming the bottom portion of the skeleton frame 20, the front columns 50, and the rear columns 60 are integrally formed. Therefore, when the storage box 10 is assembled, it is not required to assemble the boundary frame 30, the front columns 50, and the rear columns 60. Accordingly, the ease of assembly of the storage box 10 can be further improved than when the boundary frame 30, the front columns 50, and the rear columns 60 in the skeleton frame 20 are separately formed.

In addition, the gouged portions 33 that are depressed inward in the width direction from the outermost shape in the width direction of the boundary frame 30 are formed in both side portions in the width direction of the boundary frame 30, and the gouged portions 33 are formed in a recessed shape that is open outward in the width direction of the boundary frame 30. When the skeleton frames 20 are nested, the front columns 50 of the skeleton frame 20 on the lower side are disposed in the gouged portions 33 of the skeleton frame 20 on the upper side. Accordingly, even in the skeleton frame 20 where the rear columns 60 and the front columns 50 are integrally formed with the boundary frame 30, the skeleton frames 20 can be nested in a vertically stacked state. Therefore, space in the packaging form of the storage box 10 can be saved, and the transport efficiency of the storage box 10 can be improved.

In addition, the gouged portions 33 extend in the forward and rearward direction over the entire portions between the front columns 50 and the rear columns 60 in both side portions in the width direction of the boundary frame 30. Furthermore, the bottom surface of the gouged portion 33 is formed as the curved surface 33A, and in a plan view, the curved surface 33A is curved in an arc shape that is gently convex outward in the width direction of the boundary frame 30. When the skeleton frames 20 are nested, the front columns 50 of the skeleton frame 20 on the lower side are disposed in the front end portions of the gouged portions 33 of the skeleton frame 20 on the upper side, and the curved surfaces 33A of the skeleton frame 20 on the upper side are in contact with the corners 50C on the rear side of the front columns 50 of the skeleton frame 20 on the lower side. Accordingly, while the design of the storage box 10 can be improved, the skeleton frame 20 on the upper side can be suppressed from being offset forward with respect to the skeleton frame 20 on the lower side when the skeleton frames 20 are nested.

Namely, from the viewpoint that the skeleton frame on the upper side is suppressed from being offset forward with respect to the skeleton frame 20 on the lower side when the skeleton frames 20 are nested, for example, a configuration where the dimension in the forward and rearward direction of the gouged portion 33 of the skeleton frame 20 is slightly larger than the dimension in the forward and rearward direction of the front column 50 can be considered (hereinafter, this configuration is referred to as "comparative example 1"). In this case, the front columns 50 of the skeleton frame 20 on the lower side are fitted into the gouged portions 33 of the skeleton frame 20 on the upper side, so that the front columns 50 and the gouged portions 33 are engaged with each other in the forward and rearward direction. Accordingly, the skeleton frame 20 on the upper side can be suppressed from being offset forward with respect to the skeleton frame 20 on the lower side. However, in the configuration of comparative example 1, the gouged portions 33 that are open outward in the width direction of the skeleton frame 20 are locally formed in both side portions in the width direction of the skeleton frame 20. Therefore, in comparative example 1, the design of the skeleton frame 20 and the design of the storage box 10 may deteriorate.

Meanwhile, for example, in a configuration where the bottom surfaces of the gouged portions 33 are formed linearly along the forward and rearward direction in a plan view (hereinafter, this configuration is referred to as "comparative example 2"), when the skeleton frames 20 are nested, the gouged portions 33 of the skeleton frame 20 on the upper side are not in contact with the corners 50C of the front columns 50 of the skeleton frame 20 on the lower side. Therefore, when the skeleton frames 20 are nested, the skeleton frame 20 on the upper side is not restricted from moving forward. Accordingly, the skeleton frame 20 on the upper side is likely to be offset with respect to the skeleton frame 20 on the lower side, so that the packaged state of the storage box 10 may break down.

On the other hand, in the skeleton frame 20 of the present embodiment, the gouged portions 33 extend in the forward and rearward direction over the entire portions between the front columns 50 and the rear columns 60 in both side portions in the width direction of the boundary frame 30. Therefore, the gouged portions 33 that are open outward in the width direction of the skeleton frame 20 can be suppressed from being locally formed in both side portions in the width direction of the skeleton frame 20. Accordingly, the design of the skeleton frame 20 can be further improved and the design of the storage box 10 can be further improved than the above configuration of comparative example 1.

Furthermore, the bottom surface of the gouged portion 33 is formed as the curved surface 33A, and in a plan view, the curved surface 33A is curved in an arc shape that is convex outward in the width direction of the boundary frame 30. In addition, when the skeleton frames 20 are nested, the curved surfaces 33A of the skeleton frame 20 on the upper side are in contact with the corners 50C of the front columns 50 of the skeleton frame 20 on the lower side. Accordingly, portions between the portions of the curved surfaces 33A in contact with the front columns 50 (corners 50C) and the tops (central portions in the forward and rearward direction) of the curved surfaces 33A in the curved surfaces 33A of the skeleton frame 20 on the upper side are disposed further outward in the width direction than the corners 50C of the front columns 50 of the skeleton frame 20 on the lower side.

Therefore, when the skeleton frame 20 on the upper side moves forward relative to the skeleton frame 20 on the lower side, the curved surfaces 33A of the skeleton frame 20 on the upper side bite into the corners 50C of the front columns 50 on the lower side. Accordingly, the skeleton frame 20 on the upper side can be further suppressed from moving forward than the above configuration of comparative example 2. As described above, according to the skeleton frame 20 of the present embodiment, while the design of the storage box 10 can be improved, the skeleton frame 20 on the upper side can be suppressed from being offset forward with respect to the skeleton frame 20 on the lower side when the skeleton frames 20 are nested. Therefore, for example, the packaged state of the storage box 10 can be favorably maintained.

In addition, the boundary frame 30 is formed in a rectangular frame shape. Furthermore, the first reinforcement portion 34 extending in the forward and rearward direction is formed in the outer peripheral portion of the side frame portion 30S of the boundary frame 30, and the first reinforcement portion 34 is formed in a groove shape that is elevated above the boundary frame 30 and is open downward. Accordingly, the bending rigidity of the skeleton frame 20 (particularly, the side frame portion 30S) formed in a rectangular frame shape can be increased. Therefore, while the weight of the skeleton frame 20 can be reduced, the bending rigidity of the skeleton frame 20 can be increased.

In addition, when the case body 70 is accommodated in the skeleton frame 20, the first reinforcement portions 34 of the skeleton frame 20 are disposed adjacent to the outsides of the lower end portions of the side walls 70B of the case body 70 in the width direction of the skeleton frame 20. Accordingly, the first reinforcement portions that increase the bending rigidity of the skeleton frame 20 can be used to guide the case body 70 during sliding of the case body 70.

In addition, the front end portion of the first reinforcement portion 34 is inclined outward in the width direction of the skeleton frame 20 as the front end portion extends forward, to be connected to the front column 50. In addition, the rear end portion of the first reinforcement portion 34 is bent outward in the width direction of the skeleton frame 20 to be connected to the rear column 60. Therefore, the lower end portion of the rear column 60 and the lower end portion of the front column 50 are connected to each other by the first reinforcement portion 34. Accordingly, the lower end portion (root portion) of each of the rear column 60 and the front column 50 can be reinforced by the first reinforcement portion 34. As a result, for example, the rear column 60 and the front column 50 can be prevented from collapsing.

The reinforcement ribs 36 are formed inside the first reinforcement portion 34, and the reinforcement ribs 36 connect the top wall 34B of the first reinforcement portion 34 and the outer peripheral rib 31 that forms the outer reinforcement wall 34A of the first reinforcement portion 34 and the curved surface 33A of the gouged portion 33. Therefore, the outer peripheral rib 31 forming the curved surfaces 33A can be reinforced by the reinforcement rib 36. As a result, the outer peripheral rib 31 can be suppressed from being flexibly deformed inward in the width direction of the skeleton frame 20. Accordingly, when the skeleton frames 20 are nested, the skeleton frame 20 on the upper side can be effectively suppressed from being offset forward with respect to the skeleton frame 20 on the lower side.

In addition, the second reinforcement portion 35 extending in the forward and rearward direction is formed in the side frame portion 30S of the boundary frame 30, and the second reinforcement portion 35 is formed in a groove shape that is elevated below the boundary frame 30 and is open upward. The second reinforcement portion 35 is disposed adjacent to the inside of the first reinforcement portion 34 in the width direction of the skeleton frame 20, and is formed to be continuous with the first reinforcement portion 34. Therefore, the outer peripheral portion of the boundary frame 30 (side frame portion 30S) is formed in an uneven shape. Accordingly, the bending rigidity of the side frame portion 30S of the boundary frame 30 can be further increased.

In addition, the third reinforcement portion 37 extending in the rightward and leftward direction is formed in the outer peripheral portion on the rear side of the boundary frame 30, and the third reinforcement portion 37 is formed in a groove shape that is elevated above the boundary frame 30 and is open downward. Therefore, the bending rigidity of the rear frame portion 30R of the boundary frame 30 can be improved.

In addition, the third reinforcement portion 37 connects the lower end portions of the pair of right and left rear columns 60. Therefore, the lower end portions (root portions) of the rear columns 60 can be reinforced by the third reinforcement portion 37. Accordingly, for example, the rear columns 60 can be suppressed from collapsing.

Furthermore, the connection ribs 38 extending in the forward and rearward direction are formed on the upper surface of the boundary frame 30, and the connection ribs connect the first reinforcement portions 34 and the third reinforcement portion 37. Specifically, the connection ribs 38 extend rearward from the rear end portions of the inner reinforcement walls 34C of the first reinforcement portions 34 to be connected to the third reinforcement portion 37. Therefore, the reinforcement portion that is formed of the first reinforcement portions 34, the connection ribs 38, and the third reinforcement portion 37 is continuously formed in the outer peripheral portion of the boundary frame 30, and in a plan view, the reinforcement portion is formed in a substantially U shape that is open forward. Therefore, the bending rigidity of the entirety of the boundary frame 30 can be effectively increased.

In addition, the side ribs 39R that extend inward in the width direction of the boundary frame 30 from the rear columns 60 are formed on the back surface of the boundary frame 30, and the tip portions of the side ribs 39R are connected to the inner peripheral rib 32 on the rear side. Therefore, the reinforcement ribs that are formed of the inner peripheral rib 32 and the side ribs 39R extend linearly in the rightward and leftward direction in the rear end portion of the boundary frame 30 to be connected to the pair of right and left rear columns 60. Therefore, the bending rigidity of the rear end portion of the boundary frame 30 can be effectively increased, and the rear columns 60 can be effectively suppressed from collapsing.

In addition, in the storage box 10, the vertical position of the opening end surface of the case body 70 disposed in the uppermost stage coincides with the vertical position of the lower end surface of the top plate 80. Accordingly, foreign matter can be suppressed from infiltrating into the case body 70.

In addition, in the storage box 10, the vertical position of the opening end surface of the case body 70 on the lower side coincides with the vertical position of the lower end surface of the skeleton frame 20 on the upper side. Accordingly, foreign matter can be suppressed from infiltrating into the case body 70.

Incidentally, in the present embodiment, the gouged portions 33 of the skeleton frame 20 extend in the forward and rearward direction over the entire portions between the front columns 50 and the rear columns 60; however, the gouged portions 33 may be locally formed between the front columns 50 and the rear columns 60. For example, the dimension in the forward and rearward direction of the gouged portion 33 may be set to be slightly larger than the dimension in the forward and rearward direction of the front column 50, and the gouged portion 33 may be disposed adjacent to the rear side of the front column 50. In this case, when the skeleton frames 20 are nested, the front columns 50 of the skeleton frame 20 on the lower side are fitted into the gouged portions 33 of the skeleton frame 20 on the upper side, and thus the skeleton frame 20 on the upper side can be prevented from being offset forward.

In addition, in the present embodiment, the boundary frame 30 of the skeleton frame 20 is formed in a rectangular frame shape; however, the boundary frame 30 may be formed in a rectangular plate shape where the hole portion 30A and the inner peripheral rib 32 are omitted in the boundary frame 30. Furthermore, in this case, a groove-shaped hole portion into which the stopper 75 of the case body 70 is inserted may be formed in the boundary frame 30.

In addition, in the present embodiment, the reinforcement rib 36 is configured to connect the top wall 34B of the first reinforcement portion 34, the outer reinforcement wall 34A of the first reinforcement portion 34, and the gouged portion 33 (outer peripheral rib 31); however, the configuration of the reinforcement rib 36 is not limited thereto. For example, the reinforcement rib 36 may be configured to connect the inner reinforcement wall 34C, the top wall 34B, and the outer reinforcement wall 34A of the first reinforcement portion 34 and the gouged portion 33 (outer peripheral rib 31). Accordingly, the outer peripheral rib 31 forming the curved surfaces 33A can be effectively suppressed from being flexibly deformed inward in the width direction of the skeleton frame 20.

In addition, in the present embodiment, the position in the forward and rearward direction of the reinforcement rib 36 is not particularly specified, and the position in the forward and rearward direction of the reinforcement rib 36 may be set as follows. Namely, the positions in the forward and rearward direction of the reinforcement ribs 36 may be set such that one of a plurality of the reinforcement ribs 36 is disposed at a position corresponding to a portion of the curved surface 33A, the portion being in contact with the corner 50C of the front column 50 when the skeleton frames 20 are nested. Accordingly, the outer peripheral rib 31 forming the curved surfaces 33A can be more effectively suppressed from being flexibly deformed inward in the width direction of the skeleton frame 20 when the skeleton frames 20 are nested.

In addition, in the present embodiment, the curved surface 33A of the skeleton frame 20 is formed as a surface without unevenness; however, a restriction rib extending in the vertical direction or the like may be formed on the curved surface 33A. Specifically, the restriction ribs that are in contact with the corners 50C of the front columns 50 of the skeleton frame 20 on the lower side when the skeleton frames 20 are nested may be formed on the curved surface 33A. Accordingly, when the skeleton frames 20 are nested, the skeleton frame 20 on the upper side can be further suppressed from being offset forward with respect to the skeleton frame 20 on the lower side. In addition, when the restriction ribs are formed on the curved surface 33A, the bottom surface of the gouged portion 33 may be formed as a surface that is linear along the forward and rearward direction in a plan view.

What is claimed is:

1. A storage box comprising:

a plurality of skeleton frames comprising at least a first skeleton frame and a second skeleton frame; and a plurality of case bodies comprising at least a first case body and a second case body;

wherein each case body is formed in a substantially box shape that has an open top;

wherein, when the storage box is in an assembled state:

the first case body is accommodated in the first skeleton frame and the first case body is configured to slide forward and rearward within the first skeleton frame, the second case body is accommodated in the second skeleton frame and the second case body is configured to slide forward and rearward within the second skeleton frame;

wherein each skeleton frame includes:

a bottom portion comprising a front, a rear, a central section, and opposed sides, wherein each side from the opposed sides of the bottom portion comprises a gouged portion that is recessed inwardly from an outermost periphery of each side from the opposed sides, wherein each gouged portion defines an opening that faces outward in a horizontal direction with respect to the central section of bottom portion;

a pair of rear columns that are integrally formed with the bottom portion, wherein the pair of rear columns protrude upward from the opposed sides of the bottom portion along a rear section of the bottom portion, and a pair of front columns that are integrally formed with the bottom portion, wherein the pair of front columns protrude upward from the opposed sides of the bottom portion along a front section of the bottom portion, wherein each gouged portion is formed between a corresponding front column from said pair of front columns and a corresponding rear column from said pair of rear columns, and wherein, when the storage box is in the assembled state:

the skeleton frames are vertically stacked on top of each other, lower portions of the front columns of the second skeleton frame are placed on upper portions of the front columns of the first skeleton frame, lower portions of the rear columns of the second skeleton frame are placed on upper portions of the rear columns of the first skeleton frame, and the second skeleton frame is above the first skeleton frame;

wherein, when the storage box is in a disassembled state:

the skeleton frames are nested within each other, the front columns of the first skeleton frame are disposed in the gouged portions of the second skeleton frame and the second skeleton frame rests on top of the bottom portion of the first skeleton frame.

2. The storage box according to claim 1, the wherein each gouged portion defines a curved surface.

3. The storage box according to claim 1, wherein the upper portions of the front columns of the first skeleton frame comprise front fitting portions;

wherein when the storage box is in the assembled state, the front fitting portions of the first skeleton frame are placed within openings in the lower portions of the front columns of the second skeleton frame;

wherein the upper portions of the rear columns of the first skeleton frame comprise rear fitting portions;

wherein when the storage box is in the assembled state, the rear fitting portions of the first skeleton frame are placed within openings in the lower portions of the rear columns of the second skeleton frame.

4. The storage box according to claim 1, wherein a front end portion of each gouged portion is inclined, and a rear end portion of each gouged portion is inclined.

5. The storage box according to claim 1, wherein each bottom portion of each skeleton frame comprises:

a hole portion in the central section of each bottom portion, and an inner peripheral rib adjacent the hole portion of each bottom portion.

6. The storage box according to claim 5, wherein each case body comprises stoppers that protrude downwardly from a bottom wall of each case body respectively, wherein when the storage box is in the assembled state:

the stoppers of the first case body are configured to be disposed in the hole portion of the first skeleton frame; and the stoppers of the second case body are configured to be disposed in the hole portion of the second skeleton frame.

7. The storage box according to claim 6, wherein when the storage box is in the assembled state:

the first case body is configured to slide forward to a pull out position wherein the stoppers of the first case body engage the inner peripheral rib of the first skeleton frame at a front side of the hole portion of the first skeleton frame.

8. The storage box according to claim 1, wherein, when the storage box is in the assembled position:

a top plate is coupled to corresponding upper portions of corresponding front columns of a corresponding uppermost skeleton frame from said plurality of skeleton frames and corresponding upper portions of corresponding rear columns of the corresponding uppermost skeleton frame.

9. The storage box according to claim 1, wherein for each skeleton frame:

a reinforcement portion extends between and connects the pair of rear columns.

* * * * *